US012740602B2

(12) United States Patent
Ghale-Gurung

(10) Patent No.: US 12,740,602 B2
(45) Date of Patent: Sep. 22, 2026

(54) SWADDLING GARMENT

(71) Applicant: The Sleepy Company Pty. Ltd., Upper Kedron (AU)

(72) Inventor: Santosh Ghale-Gurung, Upper Kedron (AU)

(73) Assignee: The Sleepy Company Pty. Ltd., Upper Kedron (AU)

( * ) Notice: Subject to any disclaimer, the term of this patent is extended or adjusted under 35 U.S.C. 154(b) by 413 days.

(21) Appl. No.: 17/823,825

(22) Filed: Aug. 31, 2022

(65) Prior Publication Data

US 2022/0408851 A1 Dec. 29, 2022

Related U.S. Application Data

(63) Continuation of application No. PCT/AU2021/050201, filed on Mar. 5, 2021.

(30) Foreign Application Priority Data

Mar. 6, 2020 (AU) ..... 2020900691
Aug. 20, 2020 (AU) ..... 2020902977

(51) Int. Cl.
*A41B 13/06* (2006.01)

(52) U.S. Cl.
CPC ..... *A41B 13/06* (2013.01)

(58) Field of Classification Search
CPC ..... A41B 13/06; A41B 13/065; A41B 3/06; A41B 3/065; A47G 9/00; A47G 9/08; A47G 9/083; A61F 5/37; A61F 5/3723; A61F 5/3746; A61F 5/3784; A41D 10/00
USPC ..... 2/80, 83
See application file for complete search history.

(56) References Cited

U.S. PATENT DOCUMENTS 6,006,381 A * 12/1999 Tandrup ..... A47D 13/08 5/655
2005/0262633 A1* 12/2005 Haleem ..... A47G 9/066 5/482

(Continued)

FOREIGN PATENT DOCUMENTS

CN 209862335 12/2019
TW 451621 8/2001

(Continued)

OTHER PUBLICATIONS

Gill, Karen. How Long Does the Startle Reflex in Babies Last? [online], [retrieved on Dec. 6, 2024]. Retrieved from the Internet <URL:https://www.healthline.com/health/parenting/startle-reflex-in-babies (Year: 2023).*

(Continued)

*Primary Examiner* — Alireza Nia
*Assistant Examiner* — Gina Mccarthy
(74) *Attorney, Agent, or Firm* — Heslin Rothenberg Farley & Mesiti P.C.

(57) ABSTRACT

A swaddling garment for an infant is disclosed comprising an upper body part for receiving the upper body of an infant. The upper body has a back part that in use covers the infant's back, a front chest part that in uses covers the infant's chest, a right elbow region and a left elbow region. The garment may be formed from a resilient flexible material. The garment also has an opening at each elbow region that extends from the elbow region into the front chest part, and a forearm sleeve in communication with each opening. The openings and forearm sleeves are configured to allow an infant to extend a forearm through the opening into the sleeve to a predetermined forearm position.

20 Claims, 29 Drawing Sheets

(56) References Cited

U.S. PATENT DOCUMENTS

| | | | | |
|---|---|---|---|---|
| 2009/0282599 | A1* | 11/2009 | Comerford | A41B 13/06 2/69.5 |
| 2010/0252054 | A1* | 10/2010 | Slatten | A61F 5/05891 128/845 |
| 2010/0275373 | A1* | 11/2010 | Kaplan | A41B 13/06 5/494 |
| 2011/0179546 | A1 | 7/2011 | Millette et al. | |
| 2013/0333113 | A1 | 12/2013 | Talford et al. | |
| 2017/0280784 | A1* | 10/2017 | Spencer | A41B 13/06 |
| 2018/0332902 | A1* | 11/2018 | Damir | A41B 13/06 |
| 2019/0239573 | A1 | 8/2019 | Mercy | |

FOREIGN PATENT DOCUMENTS

| | | |
|---|---|---|
| WO | 2007098558 | 9/2007 |
| WO | 2011000025 | 1/2011 |
| WO | 2018015362 | 1/2018 |

OTHER PUBLICATIONS

International Search Report and Written Opinion of the International Searching Authority for International Application No. PCT/AU2021/050201 mailed on May 17, 2021, 12 pages.

Examination Report No. 1 for AU2021203634 dated Aug. 11, 2021, 7 pages.

Examination Report No. 2 for AU2021203634 dated Feb. 7, 2022, 3 pages.

Extended European Search Report issued in European Patent Application No. 21763648.9, dated Feb. 28, 2024, 7 pages.

Japanese Refusal Summary for Japanese Patent Application No. 2022-553619 by Japanese Patent Office, Oct. 29, 2024, 9 pages.

Chinese Office Action for Chinese Application No. 202180019245.7, dated Jan. 25, 2025, 15 pages.

Korean Office Action for Korean Application No. 10-2022-7034523 dated Apr. 10, 2025, 32 pages.

* cited by examiner

SWADDLING GARMENT

CROSS-REFERENCE TO RELATED APPLICATIONS

This application claims priority from International PCT Application No. PCT/AU2021/050201 filed Mar. 5, 2021, entitled Swaddling Garment, which claims benefit to Australian Patent Application No. 2020900691 filed Mar. 6, 2020 and Australian Patent Application No. 2020902977 filed Aug. 20, 2020, which are all hereby incorporated herein by reference in their entireties.

FIELD OF THE INVENTION

The present disclosure relates in general, to an infant garment or swaddling garment.

BACKGROUND OF THE INVENTION

The reference to prior art in this specification is not and should not be taken as an acknowledgment or any form of suggestion that the referenced prior art forms part of the common general knowledge in Australia or in any other country.

Swaddling refers to an ancient practice of snugly wrapping infants in blankets or sheets to restrict their movement. It is known that swaddling can help calm an infant, reduce crying time and improve sleep. Swaddled infants are placed on their backs (supine position) to sleep.

The practice of swaddling was essentially discontinued as the practice became to place infants on their stomach to sleep. The reasoning was that this reduced the risk of choking should an infant aspirate or vomit in their sleep. It was also observed that infants slept more soundly when placed on their stomach.

However, in the in the early 1990's pediatricians discovered a link between infants who were placed to sleep on their stomachs and Sudden Infant Death Syndrome (SIDS). A "Back to Sleep" campaign was launched to educate parents to place their infants on their backs to sleep.

However, parents found that infants sleeping on their backs would easily startle themselves awake. The Moro reflex, or startle reflex, is an involuntary motor response that infants develop in the womb between 28-32 weeks of gestation and usually disappears when the infant is around 3-6 months of age. It is usually triggered by sudden movements, loud or unfamiliar sounds, intense light, or sensation of falling (e.g. when a caregiver lays infant down or picks him/her up). Moro reflex involves the infant suddenly extending and spreading out his/her arms (abduction), followed by pulling in his/her arms (adduction) in front of his/her body, and usually followed by crying.

In order to address this problem of an infant's sleep patterns, the ancient art of swaddling was revived. It was observed by parents and infant caregivers, that most infants who were not swaddled to sleep woke up frequently during the night from being disturbed by their own Moro reflex.

However, there is a degree of skill and learning involved in being able to swaddle correctly. Learning to swaddle correctly requires lots of practice and patience and may not always be ideal for new mothers.

Improper swaddling is not only ineffective, but is also a safety risk. There are many known risks of improper swaddling. (Red Nose, 2017; van Sleuwen et al., 2007). Tight swaddling of an infant's legs has been associated with an increased incidence of Hip dysplasia or dislocation. Tight swaddling of an infant's chest has been associated with an increased risk for pneumonia.

On the other hand, if wrapped too loosely, an infant can usually break free from the swaddle. The loose blanket becomes a strangulation and suffocation hazard, a risk factor of Sudden Unexpected Deaths in Infancy (SUDI). Heavily wrapping the infant, or swaddling the infant with his/her head covered can cause overheating; overheating is a SUDI/SUDI risk factor.

Even when swaddled correctly all the risks are not eliminated. Swaddled infants in prone position are at a significantly increased risk of SUDI. This is because swaddled infants in prone position do not have sufficient range of motion to keep their faces off the bedding or move to a position of safety. This risk increased further with infant's age, which may be related to a greater likelihood of the infant being able to roll over to prone position with older age. (Red Nose, 2017; van Sleuwen et al., 2007). The general guideline is to stop swaddling when the infant is able to roll over. Transitioning from the swaddle causes its own set of difficulties as discussed below.

Since the "Back to Sleep" campaign, along with the increase in swaddling, it has been observed there has also been a marked increase in the incidence of infants with development delays, flat head syndrome (plagiocephaly) and wry neck (torticollis). The present inventor has observed that it is highly likely that most supine sleeping infants born after the "Back to Sleep" health education campaign in the early 1990s, were swaddled to sleep.

Research shows that infants who slept in supine position were significantly slower to attain developmental milestones (such as, head control, rolling, bringing hands to midline, tripod sitting, crawling, and standing) than infants sleeping in prone or non-supine positions (Pin et al., 2007). According to one study, at 15 months of age, infants who slept in supine position were less likely to walk upstairs and walk independently than infants who slept in prone position. (Majnemer & Barr, 2006)

The present inventor proposes that the restriction of movement due to swaddling may be contributing to these development delays more that supine sleeping itself.

The present inventor has noted that neurological research on infant motor development (and unrelated to the art of swaddling) has shown that infant care practices that limit spontaneous movement can delay the onset of motor milestones. For example, restrictive clothing as worn in very cold climates weighs down infant's limbs and can delay the onset of motor milestones. (Adolph et al., 2010) In one study, Japanese infants show delays for rolling and crawling if they are dressed in heavy, restrictive clothing, or if their bed coverings include heavy winter blankets (Hayashi, 1992).

Heavy clothing may impair self-touching behaviours of preterm newborn babies that already lack other forms of contact. Therefore, ability to freely express motor activities appears crucial for their behavioural and physiological development. (Virginie et al., 2015)

Swaddled infants are also difficult to transition out of a swaddle. By four to six months, most infants are generally able to roll from supine position to prone position, which dramatically increases the risk of SUDI. At this point there is an urgency to wean the infant off the swaddle.

The usual method practiced by parents to wean the infant off the swaddle, is initially to free one arm from the swaddle while keeping the other arm still swaddled, then after few days or weeks swaddle only the chest area with both arms out and free to move.

This method can be employed using a traditional blanket swaddle or various swaddle garments with feature that allow infant's arms to come out of the swaddle. Regardless of the product being used, parents are most likely to come across the following common problems:

a) The infant may still have mild startle reflex, enough to wake him up from his sleep.

b) His sudden new found freedom of the hands can be unsettling. His hands being restricted most of the time, the infant has not had enough opportunity and experience to develop his motor skills, thus his flailing hands can poke and scratch the infant and generally make him unsettled and hard to get to sleep.

c) Similarly, the infant has not had enough opportunity and experience to self-touch and develop self-settling or self-soothing abilities, therefore the infant is still dependant on the parent to settle or soothe him back to sleep every time he wakes during a sleep cycle.

About one in five 6 month old infants have moderate to severe sleep problems. Infant sleep problems are associated with poorer general health and mental health problems such as anxiety and depression in parents. (Martin et al., 2007)

It is increasingly common for exhausted parents to enlist the help of professional sleep consultants, or enroll the infant at expensive sleep schools. Sleep training methods used by professionals and sleep schools can vary greatly, from gentle approach to cry it out type methods. And despite the expensive sleep training it is still possible that the infant is unable to self-settle or self-soothe to sleep.

Other studies have found that infants sleeping in supine position are also more likely to develop flat head syndrome (plagiocephaly). Plagiocephaly is a condition where the infant has a flat spot on the back or side of the head. Infant's skull bones are thin and flexible and may change shape easily. Flattening of the head in one spot can occur if the infant lies with his head in the same position for extended period of time. It is estimated that 50% of infants have some form of plagiocephaly (Branch et al., 2015). In more severe cases the infant may have to go through a helmet therapy which can be costly and stressful to the infant. In rare cases surgery may be required.

Plagiocephaly is regarded as a cosmetic problem in most cases; however some studies have found that it can be a marker of elevated risk of developmental delays. Plagiocephaly can cause development delays in cognition, language, and adaptive behaviour as well as postural changes and poor balance in older children.

As mentioned above, supine sleeping position has been suggested as a risk factor for increase of plagiocephaly in infants, in addition, recent research shows most infants with plagiocephaly had comparatively poor antigravity head control, especially to the midline and side to side, with poor chin tuck (capital flexion), and extended posture in supine (Williams, 2019). The restriction to infant's movements due to swaddling may be contributing to this development delay more than supine sleeping itself. One study concludes that the rise in the incidence of plagiocephaly could be related to a lack of spontaneous and unhindered physical movement rather than to supine positioning (Cavalier et al., 2011). Similarly another study shows that a non-restrictive environment that promotes spontaneous physical movement and symmetrical motor development reduces plagiocephaly rates (Aarnivala et al., 2015).

Torticollis is a condition where the infant has tightened muscles on one side of the neck and is characterised by the infant's head to tilting or rotating to one side, limited range of motion of the head and neck, asymmetry of the face, musculoskeletal problems, small lump on the neck, and most commonly plagiocephaly appearing on the side the head is rested on. Infants can be born with this condition (congenital torticollis), usually due to the infant's positioning in utero. Some infants may also develop this condition after birth (acquired torticollis), normally due to some kind of trauma, infection, or supine sleeping with head tilted to only one side. Normally healthy infants with plagiocephaly are also more likely to develop torticollis.

Many swaddling devices have been designed with the sole view of offering ease-of-use over swaddling an infant with blankets and sheets.

Most of these swaddling devices incorporate an elongated fabric or wings or similar on two opposite sides that can be folded across the infant's front body to restrain and keep the infant's arms close to the infant's body, the two folded sides of the elongated fabric or wings are usually secured in place by means of hook-and-loop fastener.

These swaddling devices are also susceptible to other risks of improper swaddling, such as the risks of hip dysplasia and pneumonia due to tight swaddling, risk of overheating due to multiple layers of fabric wrapping the infant, and risk of suffocation due to prone sleeping position and the infant not have sufficient range of motion to keep his/her face off the bedding or move to a position of safety, thereby significantly increasing the risk of SUDI.

There are also many swaddling devices designed like a shell/cocoon which usually provide a zip-up opening and are designed to address some of the difficulties with earlier swaddles. These features are representative of those features that are considered important to those of skill in the art the art of infant garments and swaddling in particular and the common general knowledge therein.

A brief review of commercially available swaddling garments provides an insight into those features are considered important and/or problems to be addressed. These include washability, ease of opening for diaper changes, breathability of the material and being able to restrict infant's arm movements.

The present inventor has identified aspects and advantages that may be achieved with an alternative swaddling garment and method.

In the past, infant motor behaviour was regarded to be purely a reflexive behaviour and that motor development itself was the result of increasing cortical control over the lower reflexes through a gradual unfolding of predetermined patterns in the central nervous system. In other words, basic motor skills such as standing and walking, are not learned by experience but are the result of cerebral maturation.

During the last four decades neurological and psychological researchers have observed that motor behaviour is not primarily organized in terms of reflexes, and that motor development is largely affected by experience (Hadders-Algra, 2018)

In fact, various studies have shown that infants can be trained to improve motor and cognitive abilities even as early as during the neonatal period. In one study, infants who receive formal training exhibit better head control at 1 month of age, and they sit and walk at earlier ages compared with infants whose mothers do not exercise these skills. (Hopkins, 1976).

Wiesen et al. (2016) suggest that early motor training could set in motion a development cascade of new learning opportunities; boosting infants' object exploration skills and could provide a strong foundation supporting infants' future skills in multiple domains. Another study concludes that infants can undergo targeted motor training to promote executive function (EF) development (Meng et al., 2017). EF refers to the higher-level cognitive skills used to control and coordinate other cognitive abilities and behaviours.

Even already at fetal age, fetuses exhibit exploratory and goal directed arm and hand movements, and their cortex is already involved in modulating motor behaviour (Hadders-Algra, 2018).

However, there is a relative discontinuation of this exploratory and goal directed behaviour during early stage after birth due to environmental changes. The neonate goes from an aquatic to an aerial medium, from an almost dark environment to a bright one. The neonate has many new parameters to integrate into its movements. (Fagard et al., 2018).

This lack of motor control displayed by infants during the neonate period is the reason even now, in the swaddling art and amongst the children's health and care professionals, infant motor behaviour is still regarded as purely a reflexive behaviour that the infant's immature brain has little or no control over. This school of thought is especially manifested when looking at current practices in dealing with the infant's Moro reflex. Moro reflex can cause havoc on both infant's and parent's sleep when combined with our modern-day safe sleeping recommendations of sleeping infants on their back alone in their own cot. It is therefore common practice to swaddle the infant's arms securely to prevent from flailing and to suppress the Moro reflex, and parents to take on all the responsibility of settling or soothing the infant.

The lack of research conducted about the effects of swaddling on infant's development gives little motivation to think differently about the infant's own capabilities to explore and learn from day one, and the way we swaddle, settle or soothe infants during the early stages of life. However, in the field of children's development we now know that infants take an active role in their motor and cognitive development using their personal experience.

The present inventor has appreciated that healthy development is associated with spontaneous and free movement that is inconsistent with the purpose of swaddling to restrict movement.

Contrary to the prior art, the present inventor has recognized that spontaneous self-touching movements around the infant's midline may form the basis for further development and coordination of more intentional goal oriented movements and facilitates better development.

The present inventor has therefore appreciated and understood that there are several other unacknowledged or unappreciated disadvantages with how swaddling is commonly put into practice today. The present inventor has proposed a novel swaddling garment and method that may in some aspects address such problems.

SUMMARY OF THE INVENTION

According to a first aspect of the disclosure there is provided, a swaddling garment for an infant, the garment including an upper torso part for receiving the upper torso of an infant, the upper torso part having a back part that in use covers the infants back, a front chest part that in use covers the infants upper front chest, a right elbow region that in use corresponds to the location of an infant's right elbow, a left elbow region that in use corresponds to the location of an infant's left elbow in which the garment is formed from a flexible material and has an opening at each elbow region that extends from the elbow region into the front chest part, a forearm sleeve in communication with each opening, in which the opening and the forearm sleeve are relatively configured to allow an infant to extend a forearm through the opening into the forearm sleeve into a predetermined forearm position, and the infant is able to move the forearm away from the predetermined forearm position against a resistance of the flexible material, thereby biasing the forearm in the pre-determined position.

Preferably, the predetermined position is a position in which the forearms are directed towards the midline and/or or are able to move towards and around the midline.

The garment is made from any material suitable for clothing. Preferably the material is a resilient material such that the resilience of the material may provide additional bias and/or support. The resilient material may be any suitable resilient material and is preferably a blend of elastane and a natural fiber such as cotton. The natural fiber may be breathable and may resist overheating. Suitable fabrics are known to those of skill in the art of garments for infants and small children.

As the openings in the garment are in the elbow region this only allows the forearms to extend therethrough, the infants upper-arms and elbows are tucked-into the sides of the torso, with elbows bent. This restrains the infant suddenly extending and spreading out their arms as in the Moro or startle reflex.

The predetermined forearm position is determined by the relative configurations of the opening and the forearm sleeve. The forearm sleeve may therefore be considered a forearm positioner. In the present specification, the two terms are considered to be interchangeable.

The opening extends from the elbow region into the front chest part. The angle at which the opening extends from the elbow into the front part corresponds to the angle and location at which forearms are positioned in the predetermined position.

Exemplary positions include extending from the elbow region towards the midline and ending at the lower chest region that directs the forearms towards the mouth in a fetal position; extending from the elbow region towards and ends at the middle chest region, extending from the elbow region towards and ends at the lower abdomen; extends from the elbow region towards and ends at the waist side region or extends from the elbow region towards and extends towards the ears.

This allows the predetermined position to be varied and/or tuned according to an infant's developmental requirements or the like. This will be discussed further in the detailed description.

Further tuning of the pre-determined position may be obtained by the forearm sleeve or forearm positioner configuration.

In an especially preferred aspect, the predetermined position is where the forearms and hands are in the fetal-hand position in which the infant's forearms are positioned and supported in the fetal position with the forearms pointing along a line extending between the elbow and mouth.

Unlike conventional swaddling, the forearms and hands are not tightly bound or restrained, so that they are encouraged and allowed' to move 'towards and around the midline' to different parts of the infants body.

The configurations of the swaddling garment allows the infant to move his/her forearms and hands vertically around the midline from head to abdomen and medially bring forearms and hands together at the midline while lateral movement of the forearms and hands are restrained by the forearm sleeve configuration and resilience of the material.

In a preferred aspect, the degree of restraint conferred by forearm sleeve configuration the resilience of the garment material is greater in the lateral direction than for movement about the midline. As discussed further below, this simulates the position in the womb in which lateral extension of the arms is restricted by the confines of the womb.

This 'fetal-hand positioning' of the infant's forearm and hands provides the infant with optimum opportunities for spontaneous and exploratory sensorimotor activities, self-touching and midline behaviours, thereby providing numerous benefits and advantages.

In another preferred aspect, each sleeve member has an outer side having a first length and an inner side having a second length, wherein the first length is greater than the second length, such that when in the predetermined forearm position, the forearm is at an acute angle relative to the chest and the forearms and hands are positioned pointing towards the infants midline.

The shorter the second length of the inner sides in comparison to the first length of the outer sides, causing the forearm-hand positioners to extend out at even smaller angle toward the midline thereby drawing in the forearm-hand positioners even more closer to the chest of an infant in the swaddling garment and causing the forearm-hand positioner tips to point even more directly towards the midline in the direction of the mouth of an infant in the swaddling garment.

Conversely the longer the second length of the inner sides the first length areas of the inner sides in comparison to the first length of the outer side causes the hand positioners to point up and away from the chest.

At a point when the first and second lengths are the same length the forearms will be directed away from the body. This may allow more advanced and active infants to practice and get accustomed to having more freedom of movement of his/her forearm and hands while still being sufficiently swaddled to suppress the startle reflex, providing additional means for caretaker to smoothly transition/wean infant off the swaddle and overcoming the difficulties of weaning the infant off a swaddle.

In one aspect of the disclosure, the one or both forearm sleeves may be removably attached to the upper torso part of the garment. The removable attachment may be by any suitable means in the clothing arts and includes hook and loop fasters, zippers, press studs and the like. Removably attached also includes undoing a conventional sewing stitch sequence. For example, one pair of interchangeable sleeves may position the hands closer to body. Other interchangeable sleeves may position the hands laterally further away, providing more movement of arms. In a still further aspect, the interchangeable sleeves may be generally longer, also providing more movement of arms.

In a further aspect, are zippered sleeves that do not detach. A zipper may be sewn along the opening. Unzipping the zipper will increase the length of the inner side of the sleeve. This may allow a caretaker to selectively switch an infant's arm position closer to body or laterally further away from body, depending on developmental stage or preference.

The swaddling garment as disclosed herein may also be used in which one or both of the infant's forearms or hands are enclosed within the front panel for tighter swaddling. This versatility may allow an infant to be swaddled as per the infant's individual needs, development stage or preference.

The sleeve members of the garment may have different end configurations including completely covering the infants hands, having partial hand openings so as to allow part of the hands to extend therethrough or to have a full hand opening so as to allow for the whole hand to extend therethrough.

In a preferred aspect, the ends of the sleeve members are configured to be moveable between a hand covered position and a hand open position in which the infant's hand is able to extend though the hand opening.

Covering the hands may be advantageous for infants who prefer to suck on their hands through the fabric or rub their faces and touch their body parts through the fabric.

Covering their hands may also prevents their fingers from poking their eyes, and it also draws the hand further inside the forearm-hand positioners 126*a*, 126*b* reducing the degree of movement of the hands, preventing accidental slapping of their face.

When the infant's hands are uncovered and hands extended through the hand openings the infant has unrestricted access to hands and fingers; increased range of vertical, lateral, and medial forehand and hand movements.

In one aspect, the garment does not have a lower part and only covers the upper torso of the infant in a bodice type of garment. In this aspect, the garment terminates in a lower waste part. The waist part may be elasticized for fit and to restrain against the garment riding up.

In another embodiment the garment has a lower enlarged, enclosed part that allows the infant freedom to freely move their feet within the enclosed part.

In either embodiment, the garment may have a front opening for easy fitting.

In another aspect, there is disclosed a method for the prevention or treatment of plagiocephaly in an infant, comprising providing the garment as disclosed herein, placing the infant into the garment, placing one arm into one of the sleeve members to provide a free forearm and hand and placing the other hand inside the front part so as to allow the infant to suck the free hand and to periodically change the placement of the arms so as to alternate the free hand available for sucking.

In a still further aspect there is disclosed a method for the prevention or treatment of torticollis in an infant, comprising providing the garment as disclosed herein, placing the infant into the garment, placing one arm into one of the sleeve members to provide a free forearm and hand and placing the other hand inside the front part so as to allow the infant to suck the free hand and to periodically change the placement of the arms so as to alternate the free hand available for sucking.

BRIEF DESCRIPTION OF DRAWINGS

The accompanying drawings, which are incorporated in and constitute a part of the specification, illustrate embodiments of the invention and together with the detailed description herein, serve to explain the principles of the invention. It is emphasized that, in accordance with the standard practice in the industry, various features are not drawn to scale. In fact, the dimensions of the various features may be arbitrarily increased or reduced for clarity of discussion. The drawings are only for purposes of illustrating preferred embodiments and are not to be construed as limiting the invention.

DETAILED DESCRIPTION FOR CARRYING OUT THE INVENTION

Figure 1:
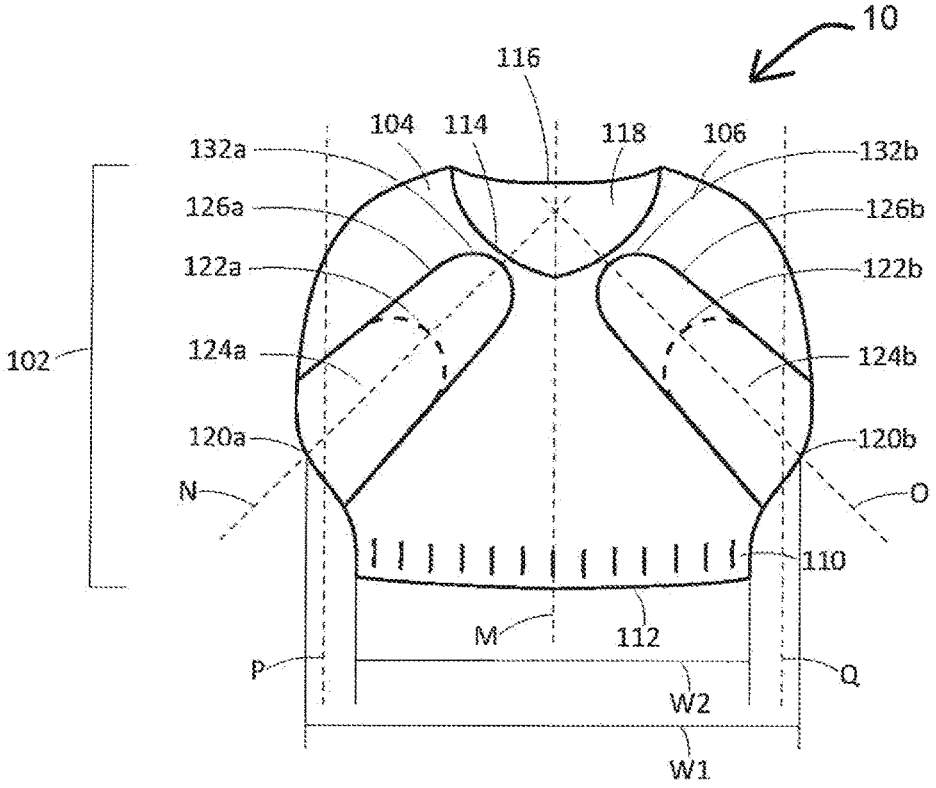
FIG. 1 is a front view of a swaddling garment, in accordance with an aspect of the present invention.

While the below description contains many specificities, these should not be construed as limitations on the scope of any embodiment, but as exemplifications of various embodiments thereof. Many other ramifications and variations are possible within the teachings of the various embodiments. Thus, the scope should not be determined by the examples given.

In the present description and claims, the term "comprising" shall be understood to have a broad meaning similar to the term "including" and will be understood to imply the inclusion of a stated integer or step or group of integers or steps but not the exclusion of any other integer or step or group of integers or steps. This definition also applies to variations on the term "comprising" such as "comprise" and "comprises".

Throughout the specification the terms neonate, newborn, infant, baby, and child shall be used interchangeably. Throughout the specification the terms parent and caregiver shall be used interchangeably.

Same or similar elements, features, and structures of the example embodiments are referred to by the same reference numerals throughout the drawings and detailed description where appropriate.

With a view to a further background observations by the inventor that are relevant to the understanding of novelty and inventive step of the present garment are discussed below.

Fetal tuck or fetal position is a positioning of the body where the back is curved, the head is bowed, the knees are bent, or flexed and drawn up to the torso, and the elbows are bent, or flexed with hands drawn up and positioned towards the midline near the face. A fetus spends most of its time in this position.

Similarly, after birth, newborns generally assume the fetal position, with their knees bent, or flexed, and the elbows bent, or flexed with hands drawn up and positioned towards the midline near the face.

Infants love the fetal position so much that any attempt to have their extremities extended when the infant is awake, may be met with crying and resistance from the infant (Lauwers & Swisher, 2015).

Babywearing research shows that infants feel physically safe and secure when they are carried with their knees flexed against the caregiver's chest, assuming the fetal position.

The fetal position is also the best position for regulating body temperature. In flexion, babies' arms and legs are bent, cutting off exposure of arteries to cold air, at the same time, reducing as much as half the surface area from chest and stomach, from which heat can be lost to air. This allows babies in the fetal position to better regulate their body temperature and as a result, use less energy trying to maintain warmth.

The fetal position is the most calming position for babies because the positioning allows babies to use less oxygen and conserve more energy. Studies have shown that in flexion, a preemie baby requires less oxygen pressure and volume and breathes easier. Less oxygen wastage also means babies in fetal position waste fewer calories and digest their food better. As their little bodies don't have to work so hard, the conserved energy and calories is devoted toward growth and development.

The fetal position is superior to the "spread out on the back" position, because it speeds up the infant muscle development while the latter adversely affects the development of their muscle tone. Additionally, the fetal position also speeds up the maturation of nerve cells that control the muscles. With stronger muscles and better functioning nerves to control those muscles, infants develop better motor skills.

The fetal position fosters healthy spine and hip development. At birth, babies will have a convex curve in the shape of the letter C. This spinal alignment is called the primary curve and develops in utero. The primary curve allows newborns to assume the fetal position by tucking their legs into a frog leg position, thighs pulling up toward the chest, while laying on their belly or when the caregiver picks them up. As such, the fetal position allows babies to maintain their primary curve alignment, reducing the pressure on the spine and hips (Schön & Silvén, 2007; Bezuidenhout, 2019).

During ultrasound, a fetus can be seen exploring the uterine wall, touching the umbilical cords, touching its own hands and fingers together at the midline, touching its feet, abdomen, chest, nose, lips, ears, rubbing its eyelids, scratching its temples with its fingers, and sucking on its hands, fingers, or thumb. The boundaries of the womb restricts lateral movement of the forearms and hands away from the midline, while encouraging and allowing movement of forearms and hands towards and around the midline, thereby facilitating these spontaneous and exploratory sensorimotor activities, self-touching and midline behaviours.

This type of dynamic positioning of the forearms and hands, the 'fetal-hand position'-whereby the infant's forearms and hands are 'positioned and supported' in the 'optimal fetal position' and 'encouraged and allowed' to move 'towards and around the midline' to different parts of its body.

Fetal hand position promotes better and healthier development, independent learning, self-settling or self-soothing abilities, and provides safety against accidently prone positioning infants.

Cognitive development is a field of study in neuroscience and psychology focusing on a child's development. Although there is no general theory of cognitive development, the most historically influential theory was developed by Jean Piaget, a Swiss Psychologist (1896-1980). In forming his "theory of cognitive development", Piaget suggests that children progress through four different stages of cognitive development: the sensorimotor, preoperational, concrete operational and formal operational period.

Piaget believed that children take an active role in their cognitive development, using their personal experience to develop their own knowledge about the world.

The sensorimotor stage (birth to 2 years) is the earliest in Piaget's theory of cognitive development. During this stage, children experience the world and gain knowledge through their senses, motor movements, and trial-and-error. A child repeats behaviour that happens unexpectedly because of his/her reflexes. For example: by chance, when a child's hand comes in contact with the mouth sucking will occur. If the sensation is pleasurable to the child, then the child will attempt to recreate the behaviour. When this behaviour is repeated often, sucking a thumb becomes the child's self-settling or self soothing habit.

Recent research suggests that sensorimotor behaviour actually originates much earlier in the womb. Fetus' first motor activity allows it to feel the space around it and to feel its body and the consequences of its movements on its body. These primitive motor movements may result in accidental contacts with the body or with the uterine environment. Such accidental contacts appear to be held in a memory of consequences, in such a way that the fetus soon starts to show a repertoire of "preferred" movements (Fagard et al., 2018). These movements of the fetus are a direct precursor of infant's exploratory sensorimotor behaviour.

Importance of Self-Touch

Infants are active explorers of their own body and peripersonal space from day 1 and that these early self-generated and deeply embodied sensorimotor experiences form the critical foundation from which future behaviors develop.

Self-touch or self-contact is an important way to settle or soothe one's self. The younger the infant, the more touch and kinesis are important for self-settling or self-soothing (Durier et al., 2015).

Self-settling or self-soothing behaviour may involve self-generated touches to the mouth, face, and the midline of the body, such as:

a) Holding hands together at the midline
b) Touching stomach or chest
c) Sucking hands, fingers, or thumb
d) Touching ears or nose
e) Rubbing eyes
f) Rubbing a lip or hair Importance of Midline Behaviour Fetal hand position facilitates bringing hands together at midline of body which usually occurs at 3 months of age (Weiss et al., 2010).

Being able to bring hands together at midline is an important foundation for consolidation of emerging bilateral skills such as mouth-hand coordination, eye-hand coordination, hand-hand coordination, and eye-hand-mouth coordination (Sherick et al., 1976).

Bringing hands to the midline, makes the infant aware of his hands and body, and bringing them to his mouth helps the infant to become aware of vision and his hands and to use them together in exploration of objects (Dennison & Lueck, 2006).

Engaging hands in the midline leads to the infant being able to extend their hands to grasp objects, hold a milk bottle, water cup, food, toys etc.

When toddlers can't hold their own cup, they struggle to stay hydrated. Babies who can't successfully hold food at midline may have trouble learning how to self-feed.

Being able to bring hands together at midline also sets the stage for another important milestone of "crossing the midline". The ability to spontaneously cross the midline plays an important role in establishing a hand preference, and coordinating and developing higher level bilateral skills such as using scissors, drawing with a crayon, tying shoes, opening snack, holding the paper while they write, sharpening a pencil, pulling their pants down in the bathroom, etc. It's part of a progression that eventually supports independence and learning.

Failure to engage in optimal amount of midline behaviour in early infancy could indicate development delays or possible developmental disorder such as autism (Sherick et al., 1976). Therefore being able to observe infants midline behaviour closely could help in early detection and intervention of such development issues.

It is common in neonatal intensive care unit (NICU) in hospitals where infants are closely monitored, to use positional devices to create boundaries that facilitate movement of limbs toward midline in flexion to support motor development and self-regulation. However, such devices are not recommended outside of hospitals due to risk of suffocation and overheating (Red Nose, 2020).

Midline behaviour helps develop strong chin tuck (capital flexion). Chin tuck (capital flexion) is the tilt of the head downwards engaging the neck flexor muscles to bring the chin closer to the chest in midline. Chin tuck is critical to counterbalancing the cervical extension and bringing about balance and stabilisation of the postural system.

For proper development of the chin tuck, it is important to facilitate midline behaviours such as sucking on hands or fingers, touching hands together or playing with objects at midline. Infants tuck their chin while sucking on their own hands or fingers, or while gazing towards their own hands or objects at the midline.

Midline behaviour may help in prevention and treatment of plagiocephaly. Facilitating midline behaviours requiring chin tuck, such as sucking on hands or fingers, touching hands together or playing with objects at midline would enable the infant to lift and move his head and help in preventing and treating plagiocephaly.

Midline behaviour may help in prevention and treatment of torticollis. The usually recommended way to treat torticollis at home is to encourage the infant to turn his head to the non-preferred side and also to the more natural midline position. In addition to positioning, Tummy Time and various stretching exercises are also recommended. In some cases the physician may recommend physical therapy, and in rare cases surgery may be required to correct the problem.

As with plagiocephaly, facilitating midline behaviours requiring chin tuck, and alternate sucking hand would help in treatment and in some cases prevention of torticollis.

The fetal-hand position provides a natural separation of baby's face from the surface in prone position. This position allows infants to use their forearms and elbows to support their head and chest off the surface and also to help them roll back from prone to supine position. The precursor for infants when learning to roll over from prone to supine position is that, they are able to bring both arms in close to their body and prop up their upper torso having one forearm laid flat with elbows tucked in and the other arm slightly extended and pushing off gently, with their back and lower limbs then doing rest of the work to complete the roll. In other words, the arm position required for rolling from prone to supine position is same as it is in the fetal hand position.

Figure 2:
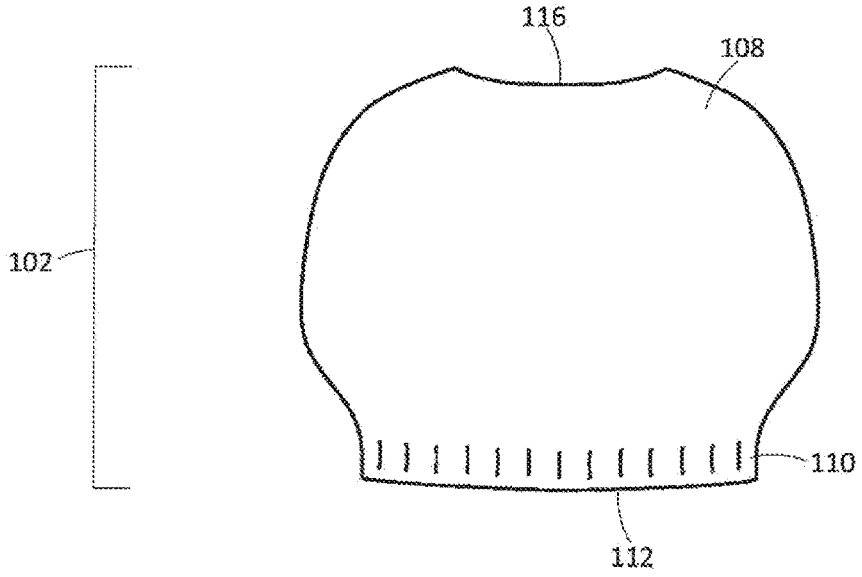
FIG. 2 is a back view of the swaddling garment of FIG. 1, in accordance with an aspect of the present invention.
Figure 3:
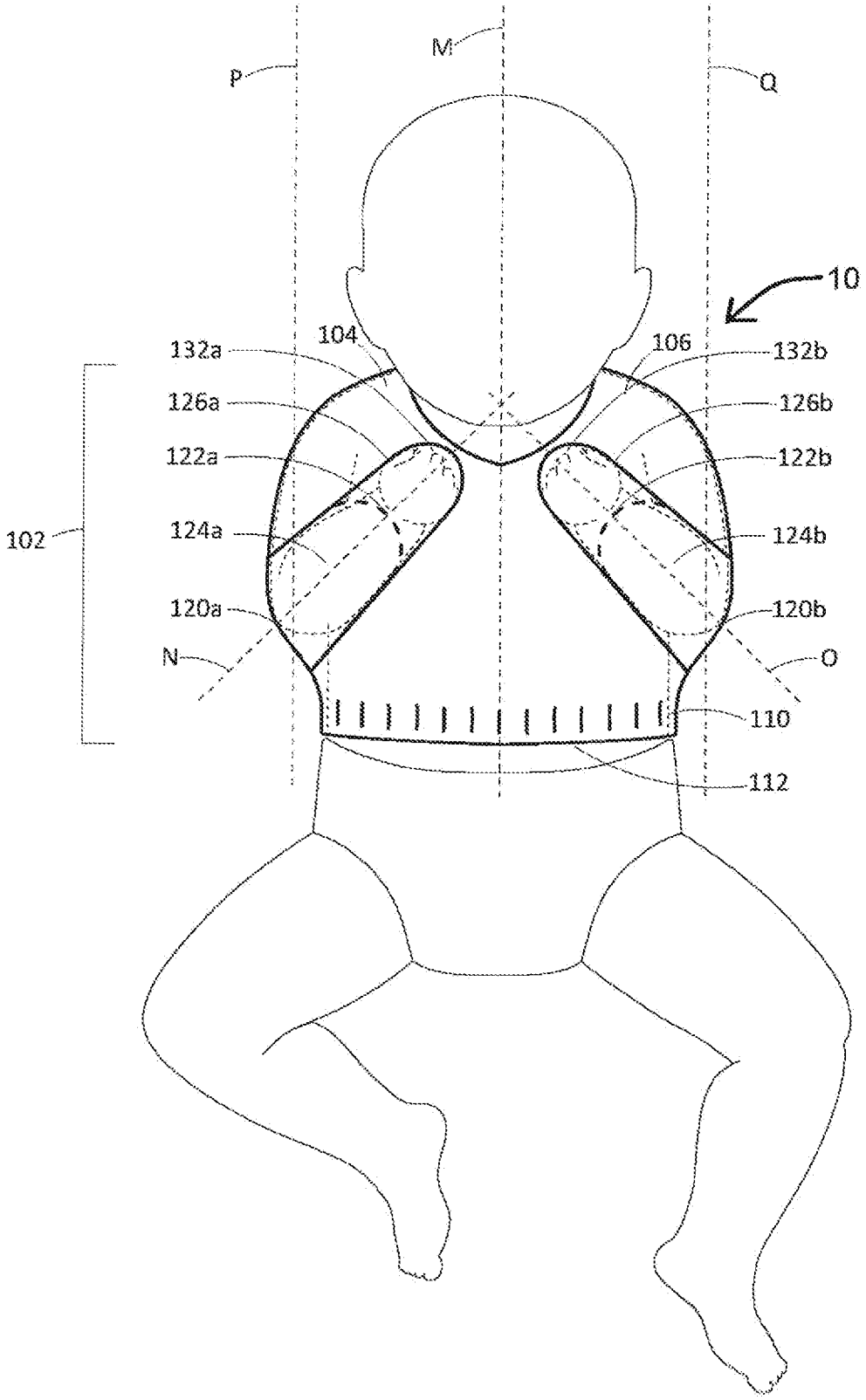
FIG. 3 is a front perspective view of an infant swaddled in the garment of FIGS. 1 and 2, in accordance with an aspect of the present invention.

FIGS. 1 and 2 show front and back view of one aspect of a swaddling garment 10 includes an that enclose the upper torso of an infant. FIG. 3 is a schematic front view showing an infant swaddled by the garment.

The garment 10 includes an upper section 102 that includes shell portion, or bodice portion, or upper-body portion 104. The shell portion 104 includes a front side, or front portion, or front panel 106, a rear side, or rear portion, or rear panel 108, and a waist region 110 having an open bottom edge 112. The front panel 106 includes a front neckline 114. The rear panel 108 includes a back neckline 116. The front neckline 114 and the back neckline 116 forms neck opening 118. The shell portion 104 define a space for receiving an infant's upper-body, with upper-arms and elbows securely tucked-in to the sides of the infant's torso (as depicted in FIG. 3).

The front panel 106 includes two elbow regions 120*a*, 120*b* and two chest regions 122*a*, 122*b*. One elbow region 120*a* is positioned in right side of the front panel 106, and one elbow region 120*b* is positioned in left side of the front panel 106 so that when swaddling garment is worn, the elbow regions 120*a*, 120*b* are positioned over each elbow of an infant. One chest region 122*a* is positioned in right side of the front panel 106, and one chest region 122*b* is positioned in left side of the front panel 106 so that when swaddling garment is worn, the chest regions 122*a*, 122*b* are positioned over each chest of an infant.

Two pocket openings, or sleeve openings, or forearm-hand openings 124*a*, 124*b* are formed on opposite sides of the front panel 106. The forearm-hand openings 124*a*, 124*b* are sized to allow the infant's forearms and hands to comfortably extend through, thereby having a perimeter that is longer than the 'circumference of the infant's forearms taken at the widest region of the forearms with the elbows bent'. Forearm-hand opening 124*a* begins at the elbow regions 120*a* and extends towards the midline M along the elbow-mouth line N and ends at the chest region 122*a*. Forearm-hand opening 124*b* begins at the elbow regions 120*b* and extends towards the midline M along the elbow-mouth line O and ends at the chest region 122*b*. The elbow-mouth lines N, O extends from the elbow regions 120*a*, 120*b* and intersects with the midline M at the approximate location of the mouth of an infant in the swaddling garment (as depicted in FIG. 3).

Extending outwardly from forearm-hand openings 124*a*, 124*b* is a pair of pocket portions, or sleeve portions, or forearm-hand portions, r forearm-hand positioners for sleeve members 26*a*, 126*b* which defines a space for receiving an infant's forearms and hands (as depicted in FIG. 3). Forearm-hand positioners 126*a*, 126*b* are wider at the base (where it joins with forearm-hand openings 124*a*, 124*b*) having the same perimeter/circumference length as that of the forearm-hand openings 124*a*, 124*b*, and narrower at the top, sized to fit an infant's hands.

The shell portion 104 is shaped to taper inwardly from the elbow regions 120*a*, 120*b* to the waist FIG. 2.) and the waist region 110 fits snugly around the waist of an infant in the swaddling garment (as depicted in FIG. 3). The waist region 110 is preferably made of elasticised material to further fit the waist region 110 snugly around the waist of an infant in the swaddling garment.

Figure 4:
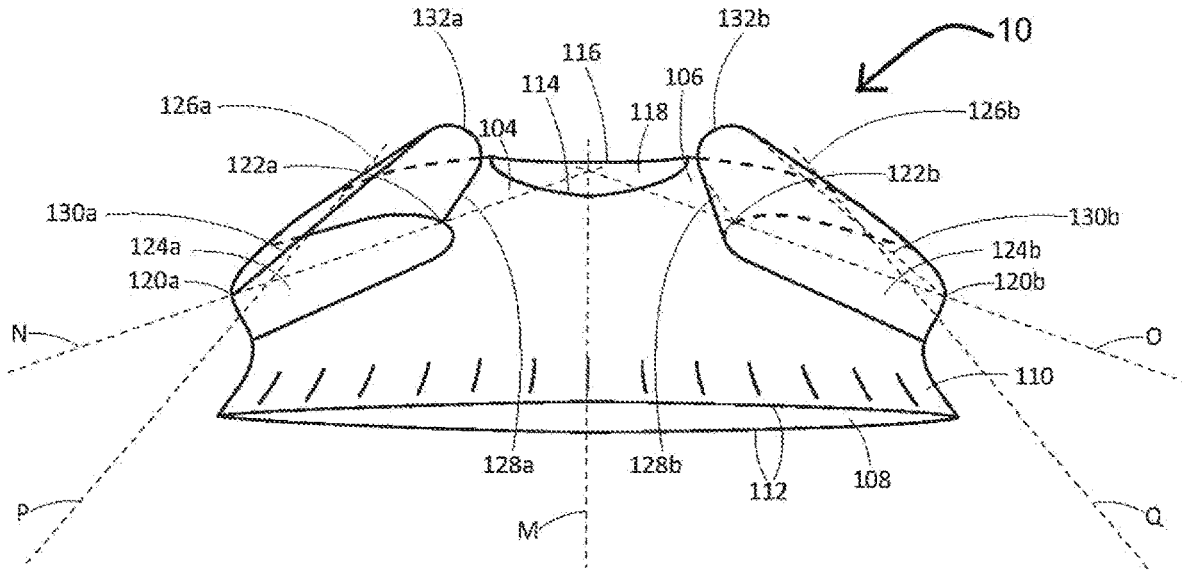
FIG. 4 is a front perspective view of the swaddling garment as shown in FIG. 1 with a cutaway section, in accordance with an aspect of the present invention.
Figure 5:
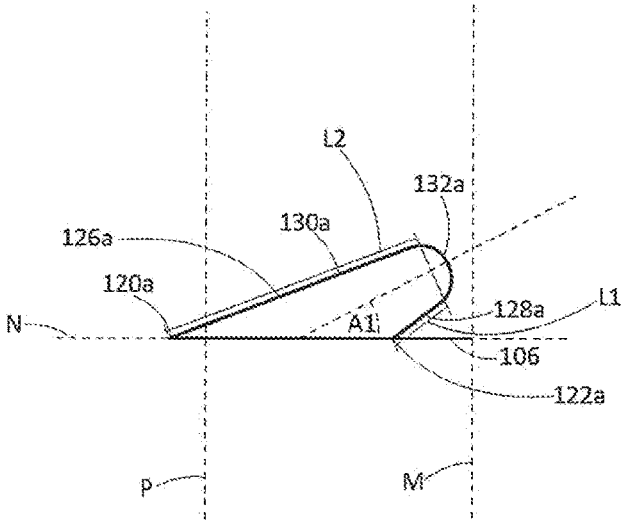
FIG. 5 is a two dimensional detail of the cutaway section of FIG. 4, in accordance with an aspect of the present invention.

As shown in FIGS. 4 and 5, forearm-hand positioners or sleeve members 126*a*, 126*b* consist of inner sides 128*a*, 128*b* extending from the respective chest regions 122*a*, 122*b*, outer sides 130*a*, 130*b* extending from the respective elbow regions 120*a*, 120*b*, and pocket portion tips, or sleeve portion tips, or forearm-hand portion tips, or forearm-hand positioner tips 132*a*, 132*b* at the topmost part of the forearm-hand positioners 126*a*, 126*b*.

In this embodiment the length L2 of outer sides 130*a*, 130*b* is approximately the length of the infant's forearms and hands with fingers in a relaxed curled state, sized for a snug fit. The length L1 of the inner sides 128*a*, 128*b* is substantially shorter (by a ratio of about 1:4) than the length L2 of outer sides 130*a*, 130*b*. This causes the space defined by the forearm-hand positioners 126*a*, 126*b* to taper towards the elbow regions 120*a*, 120*b* and causing the forearm-hand positioners 126*a*, 126*b* to extend out at an acute angle A1 toward the midline M thereby drawing in the forearm-hand positioners 126*a*, 126*b* closer to the chest of an infant in the swaddling garment and causing the forearm-hand positioner tips 132*a*, 132*b* to point towards the midline M in the direction of the mouth of an infant in the swaddling garment (as depicted in FIG. 1C).

The shorter the length L1 of inner sides 128*a*, 128*b* in comparison to the length L2 of outer sides 130*a*, 130*b* the more the space defined by forearm-hand positioners 126*a*, 126*b* tapers towards the elbow regions 120*a*, 120*b*, causing the forearm-hand positioners 126*a*, 126*b* to extend out at even smaller angle toward the midline M thereby drawing in the forearm-hand positioners 126*a*, 126*b* even more closer to the chest of an infant in the swaddling garment and causing the forearm-hand positioner tips 132*a*, 132*b* to point even more directly towards the midline M in the direction of the mouth of an infant in the swaddling garment.

Figure 6:
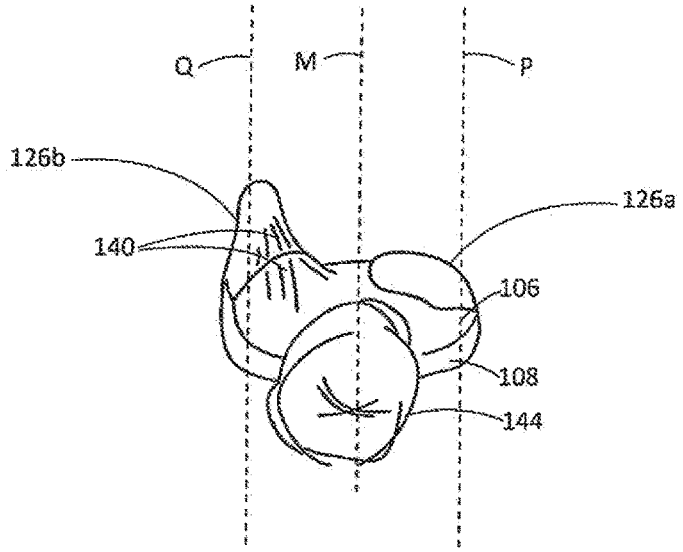
FIGS. 6, 7, 8 and 9 show schematic side views of an infant swaddled in the garment of FIG. 1 in multiple forearm and hand positions, in accordance with an aspect of the present invention.
Figure 8:
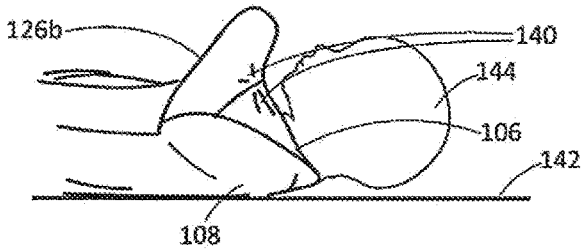
Figure 9:
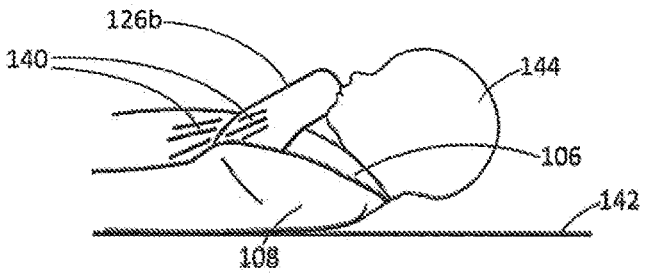
Figure 10:
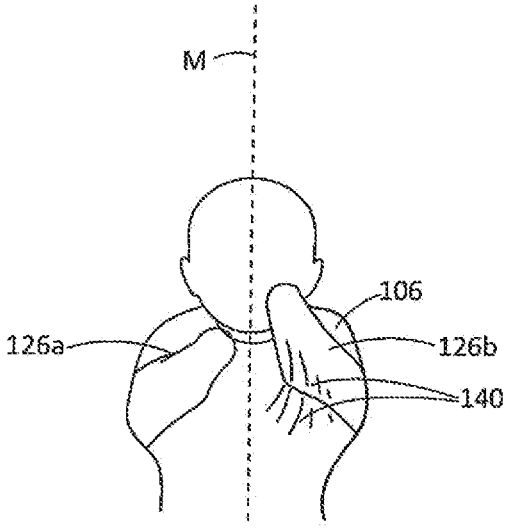
FIGS. 10, 11, 12 and 13 show schematic front views of an infant swaddled in the garment of FIG. 1 in multiple forearm and hand positions, in accordance with an aspect of the present invention.

Referring FIGS. 6 to 13, shows swaddling garment of FIG. 1 with an infant swaddled therein and showing the infant having range of movements to move his/her forearms and hands 'towards and around the midline' to different parts of the body, while providing increasing resistance (as depicted by fabric tension lines, or fabric stretch lines, or fabric resistance lines 140) as the forearms and hands move further away from the predetermined original position (forearm-hand positioners 126*a* of FIGS. 6 and 10 are in the predetermined original position therefore do not have any resistance), thereby keeping and encouraging the movement of the forearms and hands towards and around the midline region.

FIG. 6 shows one forearm-hand positioner 126*a* in original position, and forearm-hand positioner 126*b* showing fabric tension lines, or fabric stretch lines, or fabric resistance lines 140 having reached its maximum lateral movement capacity and thus being restricted to the shoulder line Q by virtue of the aforementioned configurations.

Figure 7:
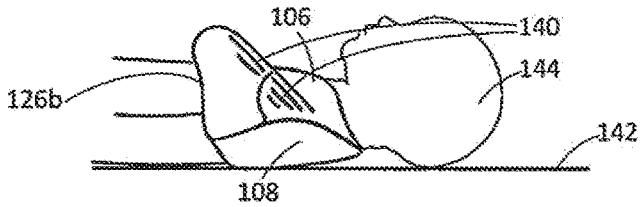

FIGS. 7 to 9 show an infant's forearms and hands moving vertically from abdomen to mouth. These Figures also show the infant performing a chin tuck (capital flexion) as he/she brings hand to mouth, thereby resulting in the head 144 being lifted off the surface 142.

Figure 11:
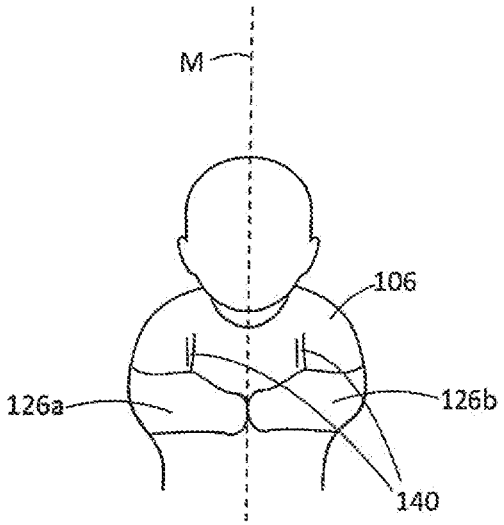
Figure 12:
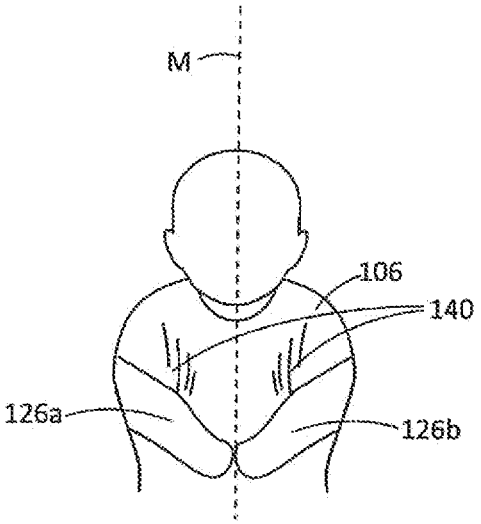

FIG. 10 shows forearm-hand positioner 126*a* in original position, and forearm-hand positioner 126*b* showing fabric resistance lines 140 having been brought up to the infant's face. FIG. 11 shows forearm-hand positioners 126*a*, 126*b* together at the midline around the chest region, and showing slight fabric resistance lines 140. FIG. 12 shows forearm-hand positioners 126*a*, 126*b* together at the midline at the abdomen region, and showing greater fabric resistance lines 140 than in FIG. 11.

Figure 13:
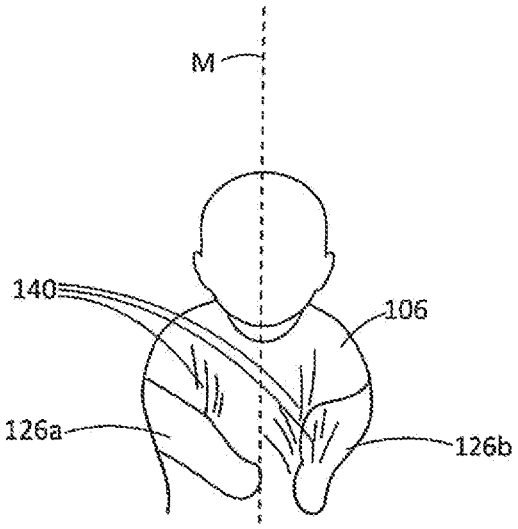

FIG. 13 shows forearm-hand positioner 126*a* at the abdomen region touching the abdomen and having no lateral movement and having fabric resistance lines 140 in one location, and forearm-hand positioner 126*b* also positioned towards the abdomen but having some lateral movement and thus having resistance lines 140 in multiple locations.

Figure 14:
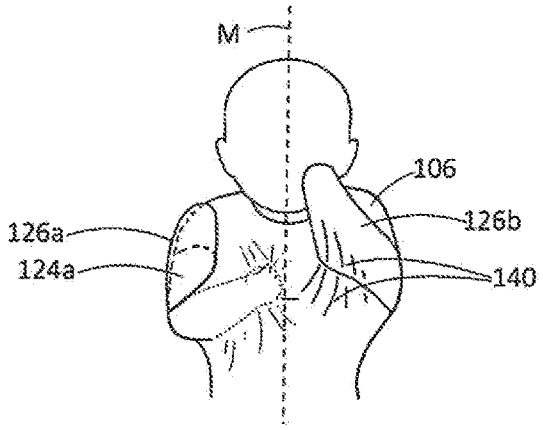
FIGS. 14, 15, 16, 17, 18 and 19 show schematic front views of an infant swaddled in the garment of FIG. 1 in multiple forearm and hand positions and different garment configurations, in accordance with an aspect of the present invention.
Figure 15:
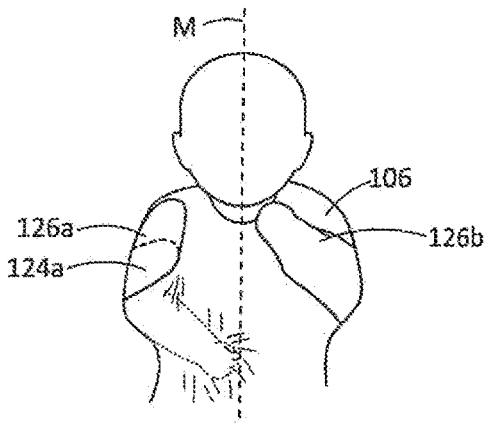
Figure 16:
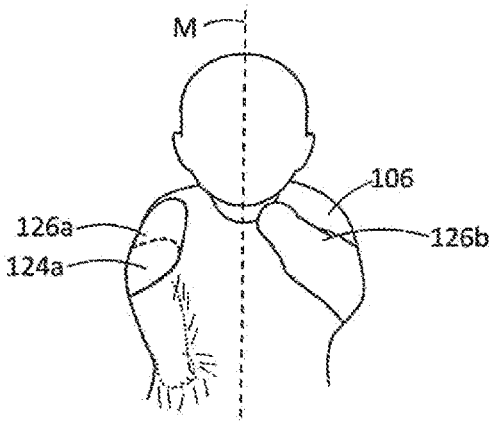
Figure 17:
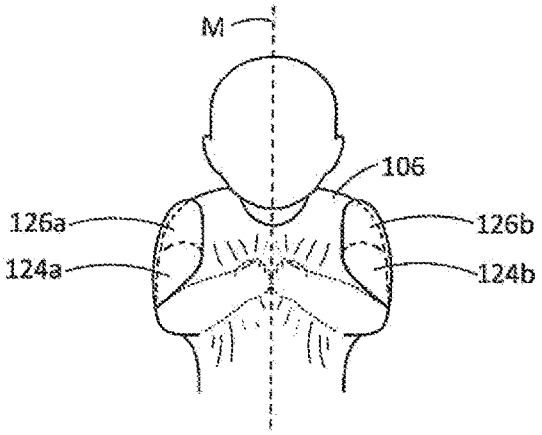
Figure 18:
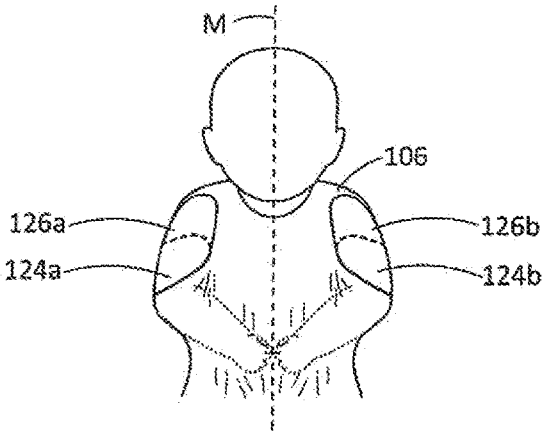
Figure 19:
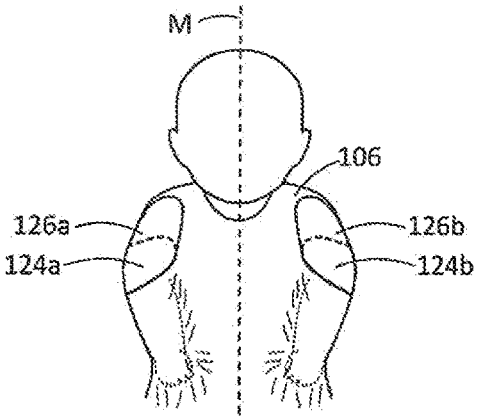

FIGS. 14 to 19 show the infant swaddled therein in multiple forearm and hand positions. FIG. 14 shows an infant's right forearm and hand completely enclosed within the font panel 106 and placed over the chest with hand at the midline, while the left forearm and hand is placed inside forearm-hand positioners 126*b*. Forearm-hand positioner 126*a* is not in use. FIG. 15 shows an infant's right forearm and hand completely enclosed within the font panel 106 and placed over the abdomen with hand at the midline, while the left forearm and hand is placed inside forearm-hand positioners 126*b*. Forearm-hand positioner 126*a* is not in use. FIG. 16 shows an infant's right forearm and hand completely enclosed within the front panel 106 and placed by the sides of the body, while the left forearm and hand is placed inside forearm-hand positioners 126*b*. Forearm-hand positioner 126*a* is not in use. FIG. 17 shows both of an infant's forearms and hands completely enclosed within the font panel 106 and placed over the chest with hands together at the midline. Forearm-hand positioners 126*a*, 126*b* are not in use. FIG. 18 shows both an of infant's forearms and hands completely enclosed within the font panel 106 and placed over the abdomen with hands together at the midline. Forearm-hand positioners 126*a*, 126*b* are not in use. FIG. 19 shows both of infant's forearms and hands completely enclosed within the font panel 106 and placed by the sides of the body. Forearm-hand positioners 126*a*, 126*b* are not in use.

The features and operation of the disclosed swaddling garment reflects the inventors understanding of the relationship between fetal position and infant motor development and how the disclosed garments may overcome the compromise between allowing mobility whilst still providing a the advantages of restrictive movement as applied by conventional swaddling.

The manner in which the disclosed garment may provide unique and unexpected advantages for infant motor and cognitive development is therefore described below.

In use, a caregiver slides or pulls the swaddling garment 10 of FIG. 1 over the infant's head, then places infant's forearms and hands in each respective forearm-hand positioners 126*a*, 126*b*, then the open bottom edge 112 is pulled down to the infant's waist.

When the swaddling garment is worn, the shell portion 104 encloses the infant's upper-body with upper-arms and elbows securely tucked-in to the sides of the infant's torso (as depicted in FIG. 3), thereby sufficiently restraining the movements of the upper-arms and elbows to suppress the startle reflex and thus minimising spontaneous awakenings.

The configuration of forearm-hand positioners 126*a*, 126*b* as disclosed by the embodiment of FIG. 1 keeps the infant's elbows bent, or flexed and positions his/her forearms and hands up-and-towards the midline of the body near the face or mouth (as depicted in FIG. 3).

The infant having his/her upper-arms and elbows securely tucked-in to the sides of the torso, with elbows bent, or flexed, and forearms and hands drawn up and positioned towards the midline of the body near the face or mouth, is effectively positioned and supported in the aforementioned 'optimal fetal position', thereby providing the infant with optimum comfort, feeling of calm and security; allowing or facilitating the infant to self-settle or self-soothe; and promoting optimum temperature regulation, growth and development of the infant.

The configurations of the swaddling garment 10 as disclosed by FIG. 1, encourages and allows the infant to move his/her forearms and hands vertically around the midline M from head to abdomen (as depicted in FIGS. 7 to 13), and medially bring forearms and hands together at the midline M in flexion (as depicted in FIGS. 10 and 11), while lateral movement of the forearms and hands are restricted to the shoulder lines P, Q (as depicted in FIG. 1), thereby effectively positioning the infant's forearms and hands in the 'fetal-hand position'.

This 'fetal-hand positioning' of the infant's forearm and hands provides the infant with optimum opportunities for spontaneous and exploratory sensorimotor activities, self-touching and midline behaviours, summarised as follows:

a) Promoting better communication between infant and parent, and thus
   1. enabling the parent to respond better to the infant's needs,
   2. improving infant parent bond,
   3. and improving parent confidence and minimising risk of maternal depression.
b) Promoting healthier cognitive and motor development, and independent learning in infants.
c) Promoting infant's ability to self-settle or self-soothe.
d) Helping in prevention and treatment of plagiocephaly and torticollis. Fetal-hand position promotes midline behaviours, which in turn promotes chin tuck which lifts the back of the head off the surface and helps strengthen the neck flexor muscles, which helps infant in moving to further move its head from side to side, thereby helping in prevention and treatment of plagiocephaly and torticollis.
e) Enabling infant to smoothly wean off the swaddle.
f) Providing safety against risks of accidental prone position. The fetal-hand position provides a natural separation of baby's face from the surface in prone position. This position allows infants to use their forearms and elbows to support their head and chest off the surface and also to help them roll back from prone to supine position, as describe in prior sections.

Shell portion 104 and forearm-hand positioners 126*a*, 126*b* are preferably constructed with material having elongation and compression ability (able to stretch and return to its original shape) such as, but not limited to fabrics having a mixed composition of cotton and spandex. The elasticity or resilience of the material allows the infant to move his/her forearms and hands to move 'towards and around the midline' to different parts of its body without restraining them, while providing increasing resistance as the forearm and hands move further away from its original position, to encourage the forearms and hands back to its original position, thereby providing support for a more "controlled movement" of the forearms and hands similar to the support provided by the aquatic (amniotic fluid) environment of the womb, thus further supporting the infant's forearms and hands in the fetal-hand position.

Additionally in use, the infant's forearms and hands can be placed and completely enclosed within the front panel 106 for tighter swaddling, instead of being placed inside the forearm-hand positioners 126*a*, 126*b*. Either one or both forearms and hands can be enclosed within the font panel 106, placed either over the chest with hands at the midline (FIGS. 14 and 15), over the abdomen with hand at the midline (FIGS. 17 and 18), or with forearms and hands by the sides of the body (FIGS. 16 and 19). This versatility allows infant to be swaddled as per the infant's individual needs, development stage or preference, providing the following benefits and advantages:

a) As mentioned in prior sections, there is a relative discontinuation of the infant's exploratory and goal directed behaviour and lack of motor control during early stage after birth due to environmental changes. The infant would therefore benefit from tighter swaddling of both or at least one arms by placing it inside the font panel 106, gradually moving into fetal-hand position where both hands are placed inside the forearm-hand positioners 126*a*, 126*b*. This would allow for smoother and quicker transition from the womb environment to the outside environment.
b) Allows infant to be swaddled more tightly during periods of sleep regressions due to illnesses, teething, growth spurts etc.
c) The ability to selectively restrict or allow movement of individual forearm and hand, allows the caretaker to train the infant to use their hands to self-settle or self-soothe to sleep, in incremental stages or baby steps. Infants who are able to use his/her hands to self-settle or self-soothe are able to cope and adjust better with eventually having their hands free, therefore helping the infant to smoothly transition/wean off the swaddle and overcoming the difficulties of weaning the infant off a swaddle.
d) As mentioned in prior sections, some infants with weak head and neck control tends to turn their head to one side for prolonged periods, while some infants do the same while sucking on one of their hands, increasing the likelihood of developing a flat spot (plagiocephaly) on one side of the head. Being able place the hand being sucked inside the font panel 106 to prevent the infant from sucking it, while placing the opposite hand in one of the forearm-hand positioners 126*a*, 126*b* would encourage the infant to turn his/her neck and head to the other side to suck on the opposite hand, thereby helping in prevention and treatment of plagiocephaly.
e) Being able to influence the turning of the infant's neck and head also helps in the treatment of torticollis by gradually stretching side of the neck with torticollis problem, as well as helping in prevention of torticollis by being able to regularly alternate the sucking side and ensuring the infant's neck is evenly stretched on both sides.

As the swaddling garment 10 of FIG. 1 in use does not cover the infant's lower-torso and legs, which provides the following benefits and advantages:

a) Provides easy nappy/diaper access and allows the caregiver to change the infant's nappy/diaper without waking or disturbing the infant.

b) Further reduces the risk of overheating, as during warmer temperatures the bottom half of the baby can be left uncovered with just a nappy/diaper.

c) In cooler temperatures it can be worn with or over other garments, such as, warm infant sleeping bags, pyjamas, bodysuits or any suitable clothing items, making the swaddling garment of FIG. 1 versatile for use in all seasons.

d) Eliminates the risks of hip dysplasia associated with tight swaddling of the hips as hips are free to move and knees free to bend in the fetal position.

e) Abel to use with any type of hip brace or hip harness.

f) Able to use with a child safety harness, such as a five point harness, for travelling in a car or a stroller.

Additionally the garment 10 of FIG. 1 may eliminate, reduce or minimize the following disadvantages.

a) hip dysplasia associated with tight swaddling of the hips, as the infant's hips are not being swaddled.

b) pneumonia associated with tight swaddling of the chest. The chest size is predetermined by the swaddle therefore there is no risk of accidentally swaddling too tightly.

c) strangulation and suffocation due to breaking free from swaddle, as it does not employ any fastening mechanism or wrapping techniques.

d) overheating due to heavy wrapping, as it is made of single layer of fabric.

e) SUDI due to prone position. The fetal-hand position provides a natural separation of baby's face from the surface in prone position. This position allows infants to use their forearms and elbows to support their head and chest off the surface and also to help them roll back from prone to supine position, as describe in prior sections.

The shell portion 104 by tucking in the upper-arms and elbows to the torso makes the upper-arms and elbows incapable of providing additional extension movements to the forearms and hands, ensuring the forearms and hands do not move or extend too far in any direction than required. The tapering towards the waist region 110 further suppresses the elbow movement. While the fitted waist region 110 helps in anchoring the shell portion 104 down. Additionally, the forearm-hand positioners 126*a*, 126*b* allows forearms and hands to move independent of the shell portion 104.

Combinations of these features work in unison to suppress infant's startle reflex, while providing optimum opportunities for "spontaneous and exploratory" sensorimotor activities, midline and self-touching behaviours, yet effectively preventing the garment from riding up, thereby eliminating the risk of suffocation due to garment riding up and covering the infant's face.

FIGS. 20 to 24 show the garment as shown in FIG. 1 with an alternative configuration of the forearm-hand positioners 126*a*, 126*b*. The forearm-hand positioners 126*a*, 126*b* include hand openings 134*a*, 134*b* through which the infant's hands may extend out, and fold-over hand mittens 136*a*, 136*b* which can be selectively folded between an open allowing an infant's hands to extend through the hand openings 134*a*, 134*b* and a closed position covering the infant's hands and retaining them inside the forearm-hand positioners 126*a*, 126*b*. The hand openings 134*a*, 134*b* are preferably made of elasticised material and sized to fit snugly at the infant's wrist, preventing infant's forearms from extending out of the hand openings 134*a*, 134*b*. For example, in FIG. 21, fold-over hand mitten 136*a* is in an open position allowing the infant's right hand to extend through the hand opening 134*a* and fold-over hand mitten 136*b* is in a closed position covering the infant's left hand and retaining it inside the forearm-hand positioner 126*b*.

Figure 20:
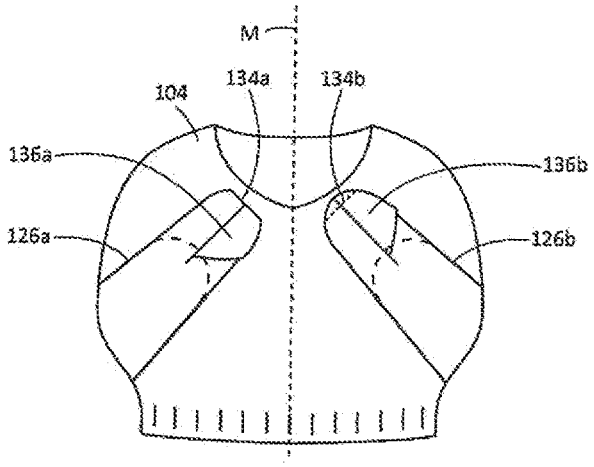
FIG. 20 is a front view of an alternative embodiment of a swaddling garment as disclosed herein, in accordance with an aspect of the present invention.
Figure 21:
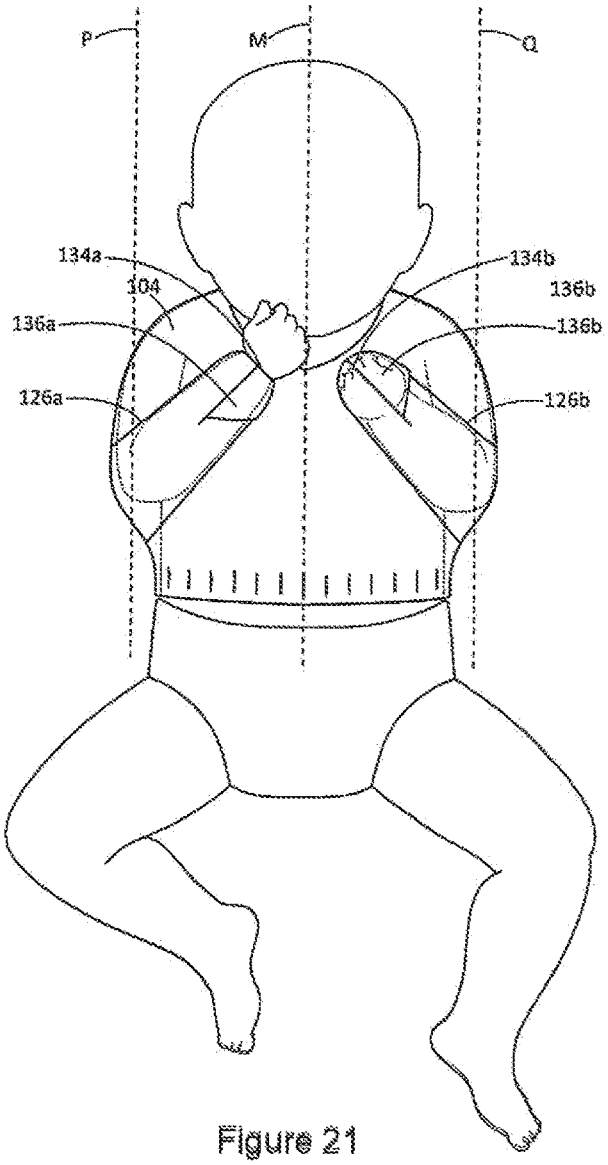
FIG. 21 is a schematic front view of the infant swaddled in the garment as shown in FIG. 20 in multiple forearm and hand positions and different garment configurations, in accordance with an aspect of the present invention.
Figure 22:
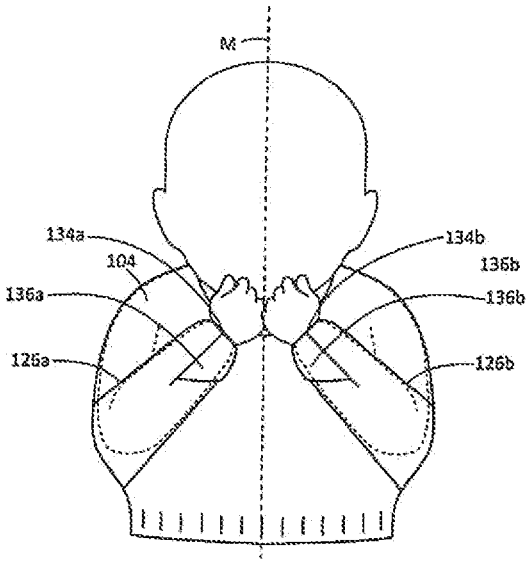
FIG. 22 shows a front view of a swaddling garment according to another aspect of the disclosure, in accordance with an aspect of the present invention.
Figure 23:
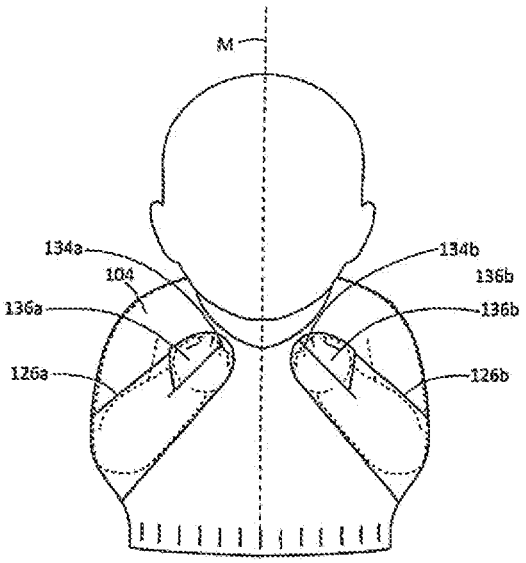
FIGS. 23 and 24 are schematic front views of the garment of FIG. 22 when worn by an infant in different configurations, in accordance with an aspect of the present invention.

When the hands are left covered, the garment of FIG. 20, maintains the same advantages of the garment of FIG. 1. The advantages of having the infant's hands covered also include:

a) Some infants have tendencies to scratch their face and head. This is especially problematic if the infant has eczema. Covering the hands prevents the scratching which may also help minimise eczema flair ups.

b) Covering the hands may be advantageous for infants who prefer to suck on their hands through the fabric, or rub their faces and touch their body parts through the fabric.

c) Some infants who are still learning to control the movement of their hands can be prone to poking themselves in the eye, or slapping themselves in the face, keeping them from falling asleep. Covering their hands prevents their fingers from poking their eyes, and it also draws the hand further inside the forearm-hand positioners 126*a*, 126*b* reducing the degree of movement of the hands, preventing accidental slapping of their face.

When the infant's hands are uncovered, with fold-over hand mittens 136*a*, 136*b* in open position and hands extended through the hand openings 134*a*, 134*b*, the infant has unrestricted access to hands and fingers; increased range of vertical, lateral, and medial forehand and hand movements; while still being positioned and supported in the 'optimal fetal position', having his/her upper-arms and elbows securely tucked-in to the sides of the torso, with elbows bent/flexed, and forearms and hands drawn up and positioned towards the midline of the body near the face or mouth, and infant's forearms and hands still remain positioned and supported in the 'fetal-hand position', being 'encouraged and allowed' to move 'towards and around the midline' to different parts of its body; and while still sufficiently keeping the upper-arms and elbows tucked-in to the sides of the torso to suppress the startle reflex.

Figure 24:
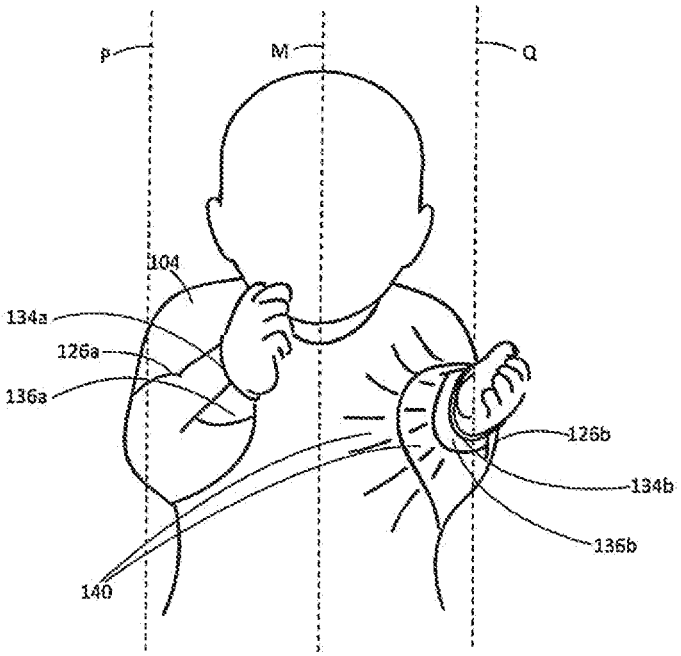

FIG. 24 shows an infant swaddled therein with the fold-over hand mittens 136*a*, 136*b* in an open position and both hands extended out of the hand openings 134*a*, 134*b*. The infant has unrestricted access to his/her hands and fingers; increased range of vertical movement along the midline, which is evident from the right hand reaching his/her face without putting any tension on the forearm-hand positioner 126*a* increased range of lateral movement, which is evident from the left hand moving away from the midline M crossing the shoulder line Q. While the hand openings 134*a*, 134*b* being fitted prevents the forearms from extending out of the hand openings 134*a*, 134*b*, thereby still encouraging the movement of the forearms and hands towards and around the midline region (as evident from the fabric resistance lines 140 shown); and still sufficiently keeping the upper-arms and elbows tucked-in to the sides of the torso (Albeit, as a consequence of having hands extended out of the hand openings 134*a*, 134*b* the upper-arms and elbows also have slightly increased movement compared to the 'securely tucked-in to the sides of the infant's torso' position provided by the embodiment depicted in FIG. 1) to suppress the startle reflex.

In use, garment of FIG. 20 allows the caregiver to selectively cover or uncover both or alternating hands of the infant as may be required, depending on the infant's individual needs or preference, development stage and other factors; the advantages of which may include:

a) A caretaker being able to quickly transition an infant from sleep position to tummy time play, simply by uncovering the hands, and without having to change into another garment. This provides convenience and time saving for the caretaker and minimal disturbance for the infant.

b) Being able to convert and use the swaddling garment in the form similar to a regular garment, and use for much longer period provides further versatility and cost saving.

c) Infants who have gained better motor control or with early preference to directly suck on their hands, fingers or thumbs is able to do so by a caretaker uncovering the infant's hands.

d) The ability to switch alternating hands from being covered to uncovered provides an easier alternative way to further influence the hand being sucked, thereby further helping in prevention and treatment of plagiocephaly and torticollis, especially for infants who have tendencies to turn their head to one side for prolonged periods either due to weak head and neck control, tilting their head while sucking on their hands, or due to an existing torticollis on one side.

e) Being able to selectively cover or uncover both or alternating hands provides additional means for caretakers to use for better understanding of the infant's needs, and for helping in improvement of infant's motor and cognitive development.

f) Being able to selectively cover or uncover both or alternating hands provides additional means for caretakers to train the infant to use their hands to self-settle or self-soothe to sleep, in further incremental stages or baby steps.

g) Being able to selective allow an infant additional freedom of movement of his/her forearm and hands, while still sufficiently suppressing his/her startle reflex, directly overcomes the aforementioned difficulties of having to wean the infant off swaddling prematurely (while the infant still has sufficient level of startle reflex to startle him/her awake) due to the infant showing signs of rolling from supine to prone sleeping position.

h) A baby's swaddle used over time can become a strong sleep association. T the lesser changes to the baby's environment during weaning off the swaddle the smoother the outcome. Being able to selectively uncover the infant's hands allows the infant to use the swaddling garment for much longer duration, making transitioning/weaning off the swaddle a more smoother process.

The ability to fully use hands and fingers without restrictions, the additional freedom of movement of the forearms and hands, while still being sufficiently swaddled can be additionally advantageous for:

a) Older and more active infants who enjoy reaching, grasping and exploring objects but still have some level of startle reflex.

b) Older children or adults with special needs.

Figure 25:
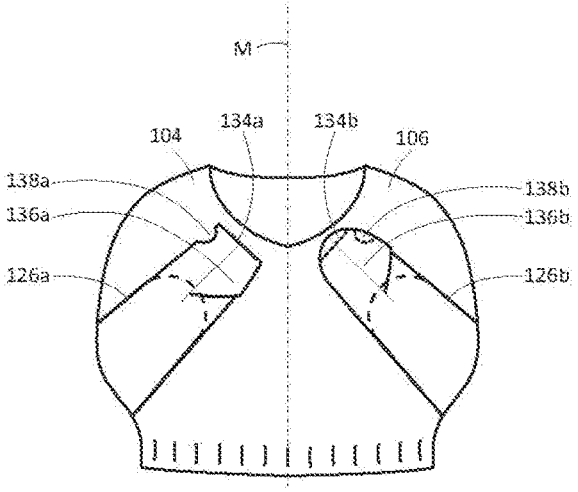
FIG. 25 is a front view of an alternative embodiment of a swaddling garment as disclosed herein, in accordance with an aspect of the present invention.
Figure 26:
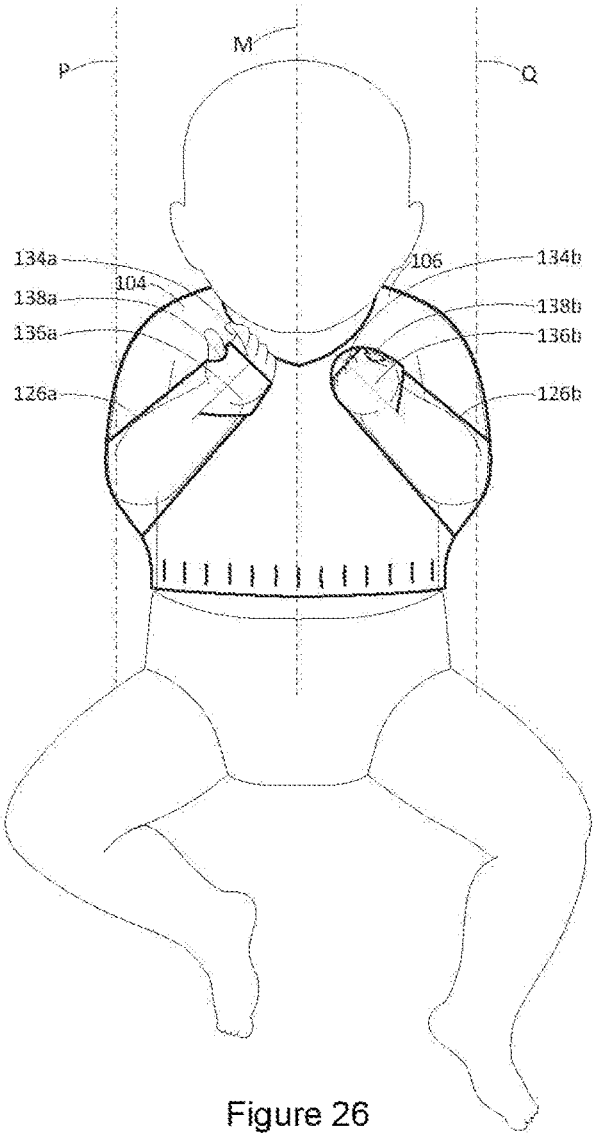
FIGS. 26, 27 and 28 are schematic front views of an infant swaddled in the garment as shown in FIG. 25 in different configurations, in accordance with an aspect of the present invention.
Figure 27:
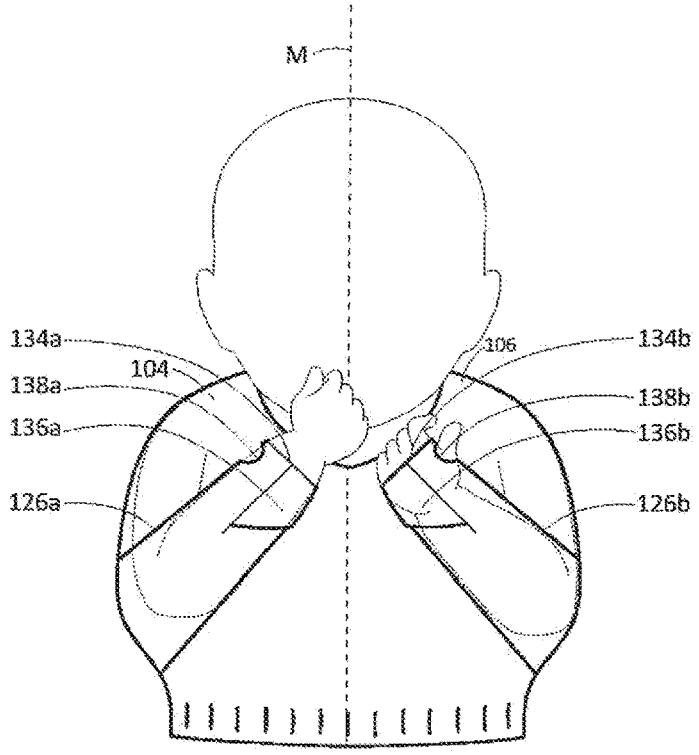
Figure 28:
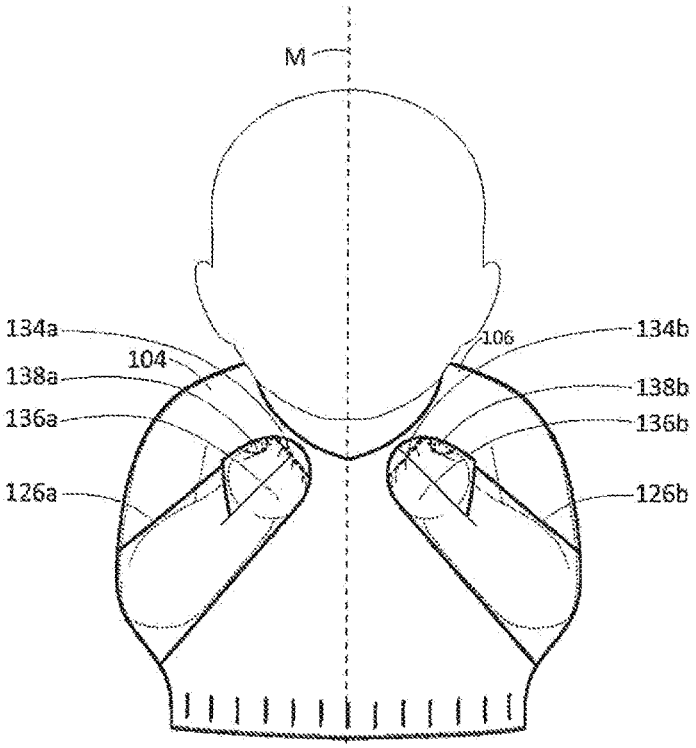
Figure 29:
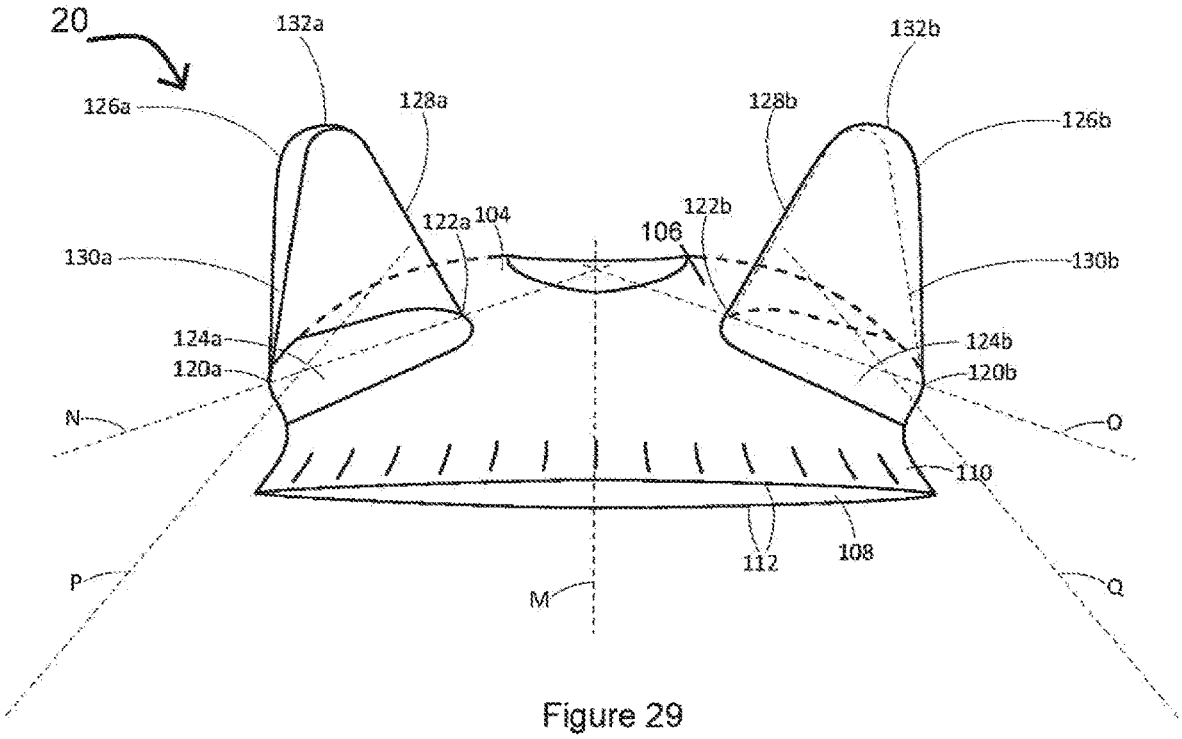
FIG. 29 is a lower perspective view of a still further garment in an aspect as disclosed herein, in accordance with an aspect of the present invention.
Figure 30:
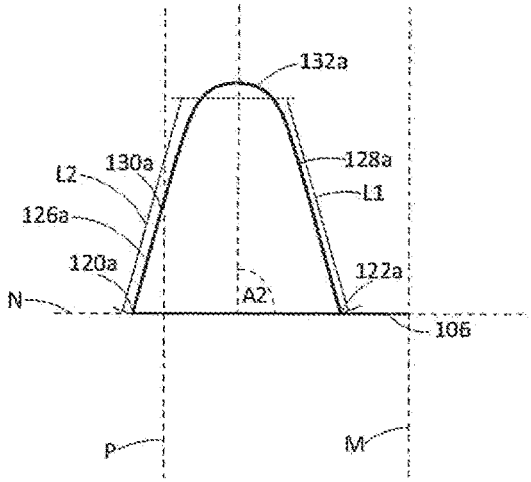
FIG. 30 is a two dimensional detail from FIG. 29, in accordance with an aspect of the present invention.
Figure 31:
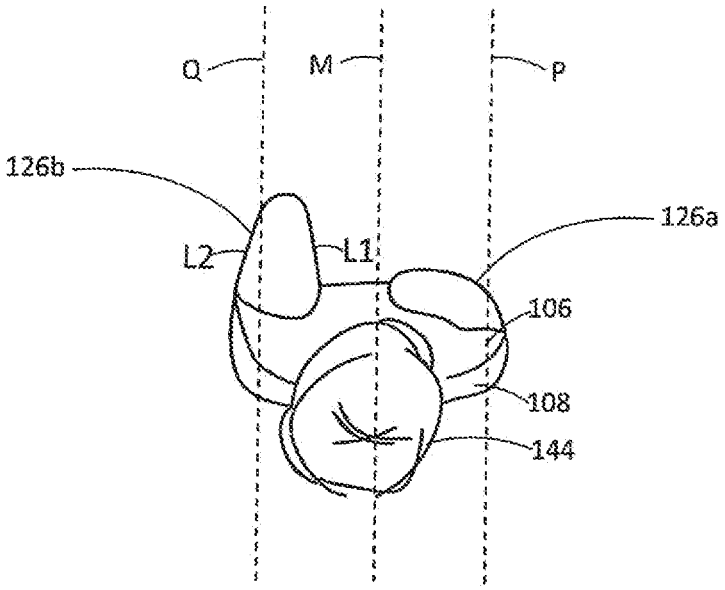
FIG. 31 is a schematic top view of an infant swaddled in the garment as shown in FIG. 30, in accordance with an aspect of the present invention.
Figure 32:
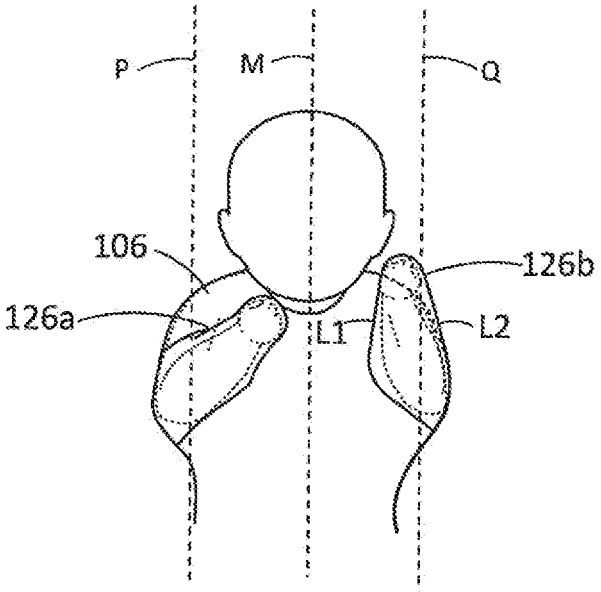
FIG. 32 is a schematic front of an infant swaddled in the garment as shown in FIG. 30, in accordance with an aspect of the present invention.

Referring to FIGS. 25 to 28 shows the basic garment as shown in FIGS. 1 and 20 but with a further configuration of the forearm-hand positioners 126*a*, 126*b* The forearm-hand positioners 126*a*, 126*b* includes: hand openings 134*a*, 134*b* through which the infant's hands or fingers may extend out, and fold-over hand mittens 136*a*, 136*b* which can be selectively folded between an open position FIGS. 25, 26, 27 allowing an infant's hands or fingers to extend through the hand openings 134*a*, 134*b* and a closed position FIGS. 25, 26, 27 covering the infant's hands and retaining them inside the forearm-hand positioners 126*a*, 126*b*.

The hand openings 134*a*, 134*b* are sized to have a perimeter/circumference length that is shorter than the circumference of an infant's forearm but longer than the circumference of the infant's wrist; thus when the swaddling garment is in use with the fold-over hand mittens 136*a*, 136*b* in an open position, the infant's hands can completely extend through the hand openings 134*a*, 134*b* with the infant's forearms also able to partially (but not completely) extend through the hand openings 134*a*, 134*b*.

The forearm-hand positioners 126*a*, 126*b* further include thumb holes 138*a*, 138*b* near the hand openings 134*a*, 134*b* through which the infant's thumbs may extend out and thus anchoring the forearm-hand positioners 126*a*, 126*b* to the thumb of an infant in the swaddling garment and preventing infant's forearms from extending out of the hand openings 134*a*, 134*b* (FIGS. 25, 26).

For example, in FIG. 26, fold-over hand mitten 136*a* is in an open position allowing the infant's right hand fingers to extend through the hand opening 134*a* and thumbs to extend through the thumb hole 138*a*, and fold-over hand mitten 136*b* is in a closed position covering the infant's left hand and retaining it inside the forearm-hand positioner 126*b*.

When the hands are left covered, the garment of FIG. 24, maintains the same advantages of the embodiment of FIG. 1.

When the infant's hands are uncovered with fold-over hand mitten 136*a*, 136*b* in open position and thumbs extended through the thumb holes 138*a*, 138*b* and fingers extended through the hand openings 134*a*, 134*b*, the infant has unrestricted access to his/her fingers; increased range of vertical, lateral, and medial forehand and hand movements; while still being positioned and supported in the 'optimal fetal position', having his/her upper-arms and elbows securely tucked-in to the sides of the torso, with elbows bent/flexed, and forearms and hands drawn up and positioned towards the midline of the body near the face or mouth, and infant's forearms and hands still remain positioned and supported in the 'fetal-hand position', being 'encouraged and allowed' to move 'towards and around the midline' to different parts of its body; and while still sufficiently keeping the upper-arms and elbows tucked-in to the sides of the torso to suppress the startle reflex.

When the infant's hands are uncovered with fold-over hand mitten 136*a*, 136*b* in open position and thumb holes 138*a*, 138*b* not in use, the infant's hands can completely extend through the hand openings 134*a*, 134*b* with the infant's forearms also able to partially (but not completely) extending through the hand openings 134*a*, 134*b* (FIG. 27), giving the infant unrestricted access to hands and fingers; further increasing the range of vertical, lateral, and medial movements of the forearms and hands; further increasing the range of movements of the upper-arms and elbows; and while still retaining some restriction of movements of the upper-arms and elbows to suppress milder level of startle reflex and to provide the infant with comforting and secure feeling of being hugged. Infants in this swaddling position are assumed to be in a later phase of the transitioning/weaning off the swaddle, having gained better control of their forearms and hands to move and maintain them 'towards and around the midline' region and to self-soothe with minimal support from the forearm-hand positioners 126*a*, 126*b*; having preference for greater freedom of movement. However, while the startle reflex of these later phase infants would have greatly subsided, they would still be craving for comfort and security of the womb like environment for many more months.

Thus in this case the garment of FIG. 25 allows a caretaker to selectively provide infant with additional degree of freedom of movement of the upper limbs; allowing the infant to be trained progressively to transition from requiring forearms and hands to be fully positioned and supported in the 'fetal-hand position' by the forearm-hand positioners 126*a*, 126*b*, to being able to move and maintain forearms and hands 'towards and around the midline' region and to self-soothe on their own, requiring minimal to no support from the forearm-hand positioners 126*a*, 126*b*; facilitating transitioning/weaning the infant off the swaddle in even more gradual steps, and making transitioning/weaning off the swaddle an even more smoother process.

FIGS. 29 to 32 show an alternative configuration of the inner sides 128*a*, 128*b* and outer sides 130*a*, 130*b* of a forearm-hand positioners 126*a*, 126*b* for a swaddling garment 20 is shown, in which both the length L1 of the inner sides 128*a*, 128*b* and the length L2 of the outer sides 130*a*, 130*b* have same length which is approximately the length of the infant's forearms and hands (with fingers in a relaxed curled state, sized for a snug fit), thereby causing the forearm-hand positioners 126*a*, 126*b* to extend forward and away from the body of an infant in the swaddling garment at a right angle A2 and the forearm-hand positioner tips 132*a*, 132*b* to point forward and away from the infant's body.

FIGS. 33 to 36 show another alternative configuration of the inner sides 128*a*, 128*b* and outer sides 130*a*, 130*b* of a forearm-hand positioners 126*a*, 126*b* for a swaddling garment 30 is shown, in which the length L2 of the outer sides 130*a*, 130*b* is approximately the length of the infant's forearms and hands (with fingers in a relaxed curled state, sized for a snug fit), and length L1 of the inner sides 128*a*, 128*b* is longer than length L2, thereby causing the space defined by the forearm-hand positioners 126*a*, 126*b* to taper towards the chest regions 122*a*, 122*b* and causing the forearm-hand positioners 126*a*, 126*b* to extend more laterally and away from the midline M at an obtuse angle A3 and the forearm-hand positioner tips 132*a*, 132*b* to point more laterally and away from the midline M.

Figure 37:
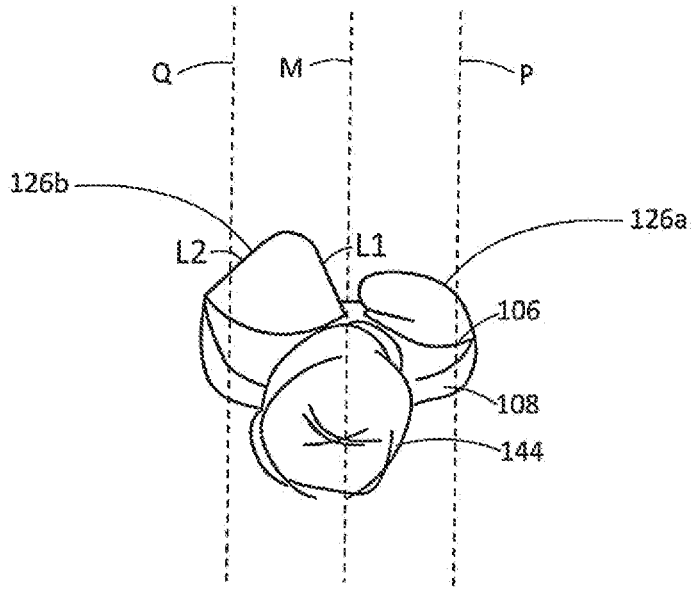
FIG. 37 is a schematic top view of an infant swaddled in another garment as disclosed herein, in accordance with an aspect of the present invention.
Figure 38:
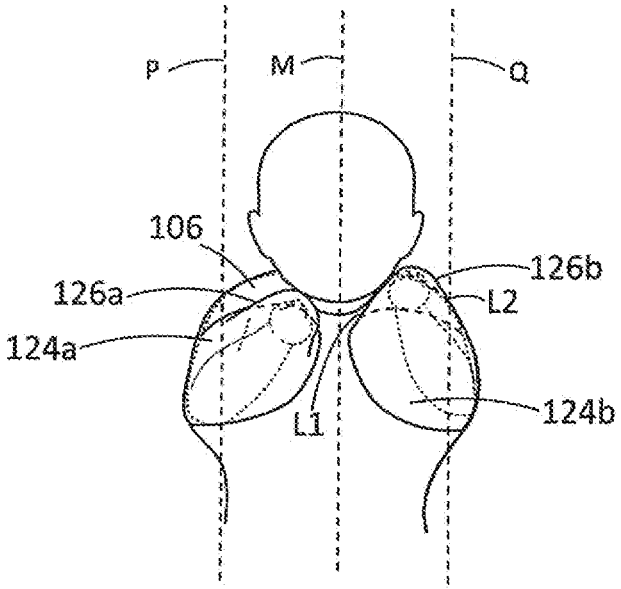
FIG. 38 is a schematic front of an infant swaddled in the a still further garment as disclosed herein, in accordance with an aspect of the present invention.

FIGS. 37 and 38 show another alternative configuration of the inner sides 128*a*, 128*b* and outer sides 130*a*, 130*b* of a forearm-hand positioners 126*a*, 126*b* in combination with alternative configuration of a forearm-hand openings 124*a*, 124*b* for a swaddling garment is shown, in which both the length L1 of the inner sides 128*a*, 128*b* and the length L2 of the outer sides 130*a*, 130*b* have same length which is approximately the length of the infant's forearms and hands (with fingers in a relaxed curled state, sized for a snug fit). However, unlike the configuration of FIGS. 29 to 32, the configuration of FIGS. 37 and 38 is configured to have forearm-hand openings 124*a*, 124*b* of much larger perimeter such that they almost entirely cover the chest of the infant on their respective sides; the forearm-hand openings 124*a*, 124*b* begins at the elbow regions 120*a*, 120*b*, extend past the chest regions 122*a*, 122*b*, ending very close below the front neckline 114 and close to the midline M; thus even if the length L1 of the inner sides 128*a*, 128*b* and length L2 of the outer sides 130*a*, 130*b* are configured to be of same length, unlike the configuration of FIGS. 29 to 32, the infant's forearms and hand would still be positioned somewhat up-and-towards the midline of the body near the face or mouth, which is a positioning more similarly to the garment of FIG. 1.

The configuration of FIGS. 29 to 38 otherwise retains the same features as the embodiment depicted in FIG. 1.

The configuration of FIGS. 29 to 38 can be used in a similar manner to garment of FIG. 1, thereby providing the same advantages as that of embodiment of FIG. 1.

The configuration shown in FIGS. 29 to 32 however positions the infant's forearms and hands laterally away from the midline M and more closer to the shoulder lines P, Q (by virtue of length L1 and length L2 being of same length) allowing wider range of vertical and lateral movements of the forearms and hands, than allowed by the embodiment of FIG. 1; while the infant is still able to medially move the forearms and hands to the midline M (facilitating the infant's forearms and hands in the 'fetal-hand position'), by virtue of length L2 being approximately the length of the infant's forearms and hands (which is the same as length L2 of the embodiment of FIG. 1).

Figure 33:
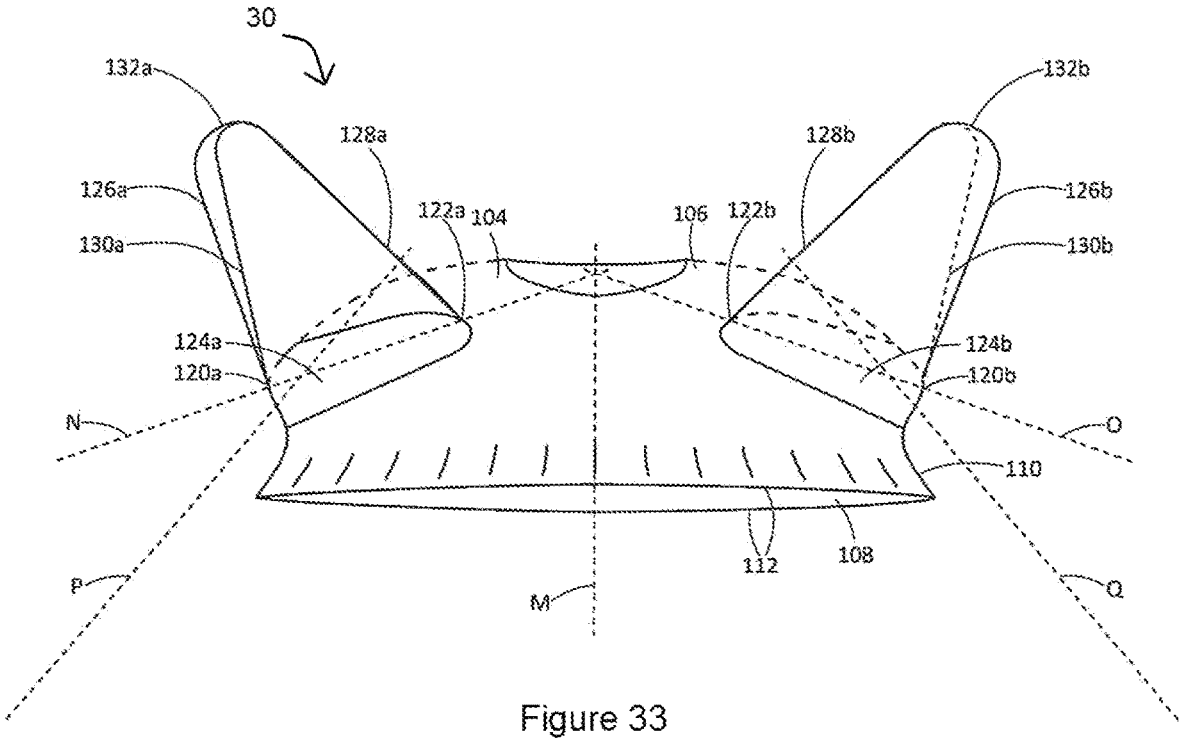
FIG. 33 is a lower perspective view of a still further garment in an aspect as disclosed herein, in accordance with an aspect of the present invention.
Figure 34:
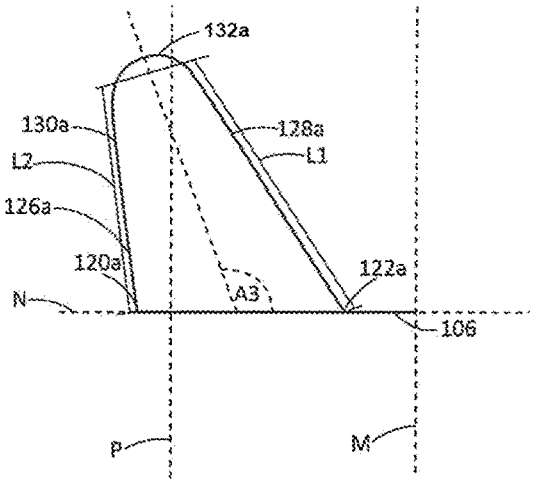
FIG. 34 is a two dimensional detail from FIG. 33, in accordance with an aspect of the present invention.
Figure 35:
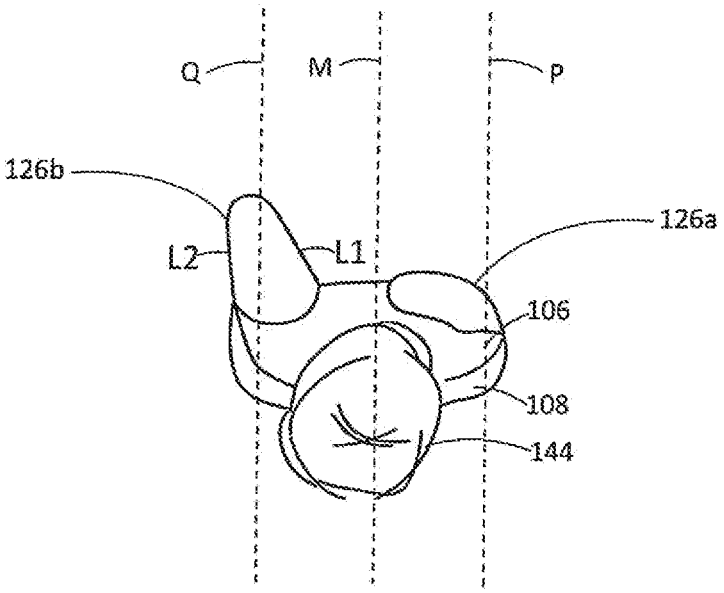
FIG. 35 is a schematic top plan view of an infant swaddled in a garment in accordance with another aspect of the disclosure, in accordance with an aspect of the present invention.
Figure 36:
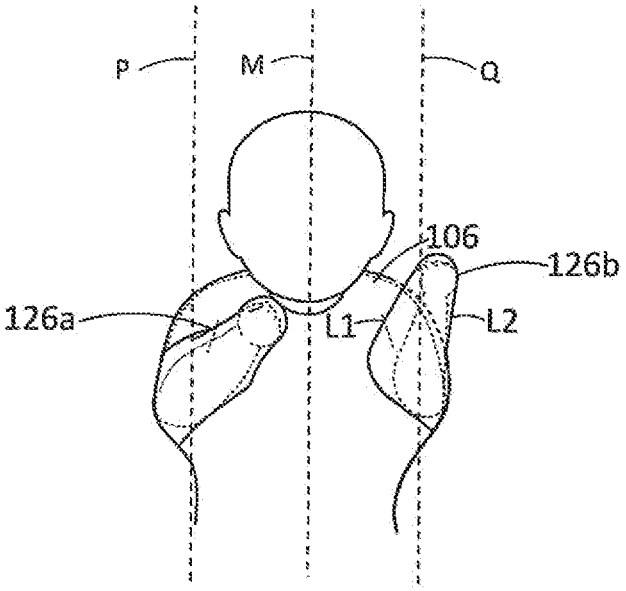
FIG. 36 is a schematic front view of an infant swaddled in the garment as shown in FIG. 35, in accordance with an aspect of the present invention.

Similarly, the configuration of FIGS. 33 and 34 positions the infant's forearms and hands laterally further away from the midline M crossing the shoulder lines P, Q (by virtue of length L1 being longer than length L2) allowing further increased range of vertical and lateral movements of the forearms and hands, than allowed by the configuration of FIGS. 29 to 32; while the infant is still able to medially move the forearms and hands to the midline M (facilitating the infant's forearms and hands in the 'fetal-hand position'), by virtue of length L2 being approximately the length of the infant's forearms and hands (which is the same as length L2 of the embodiment of FIG. 1).

Both configurations of FIGS. 29 to 32 and FIGS. 33 to 38 still maintains the infant's upper-arms and elbows securely tucked-in to the sides of the infant's torso, with elbows bent/flexed, and forearms and hands drawn up, thereby sufficiently restraining the movements of the upper-arms and elbows to suppress the startle reflex and thus minimising spontaneous awakenings.

The configurations of FIGS. 29 to 32 and FIGS. 33 to 38 provide the following additional advantages to that of embodiment of FIG. 1:

a) For some infants, their 'optimal fetal position' may involve positioning their forearms and hands further away laterally from the midline M during periods of sleeps, while preferring to move their forearms and hands towards and around the midline when awake. This preference may be natural or acquired due to use of different swaddling method/device in the past. The configurations of FIGS. 29 to 32 and FIGS. 33 to 38 allows these infants to be positioned and supported during period of sleeps in their preferred 'optimal fetal position', having upper-arms and elbows securely tucked-in to the sides of the torso, with elbows bent/flexed, and forearms and hands drawn up and positioned further away laterally from the midline M; while awake the infant's forearms and hands is positioned and supported in the 'fetal-hand position', being 'encouraged and allowed' to move 'towards and around the midline' to different parts of its body; and while still sufficiently keeping the upper-arms and elbows tucked-in to the sides of the torso to suppress the startle reflex.

b) Allows more advanced and active infants to practice and get accustomed to having more freedom of movement of his/her forearm and hands while still being sufficiently swaddled to suppress the startle reflex, providing additional means for caretaker to smoothly transition/wean infant off the swaddle and overcoming the difficulties of weaning the infant off a swaddle.

c) Provides additional means for swaddling of older children or adults with special needs and who may have preference for more freedom of movement of forearm and hands while preferring to have their upper-arms and elbows securely tucked-in to the sides of the infant's torso for additional feeling of security and assurance.

Referring to 39 to 43, the swaddling garments 30A, 30B, 30C, 30D and 30E, various alternative configurations of the forearm-hand openings 124*a*, 124*b* for a swaddling garment are shown, in which the configurations of the forearm-hand openings 124*a*, 124*b* influences the extension direction of the forearm-hand positioners 126*a*, 126*b* and the direction the forearm-hand positioner tips 132*a*, 132*b* points towards, thereby allowing the infant's forearms and hands to be positioned in varying positions vertically along the infant's body.

Figure 39:
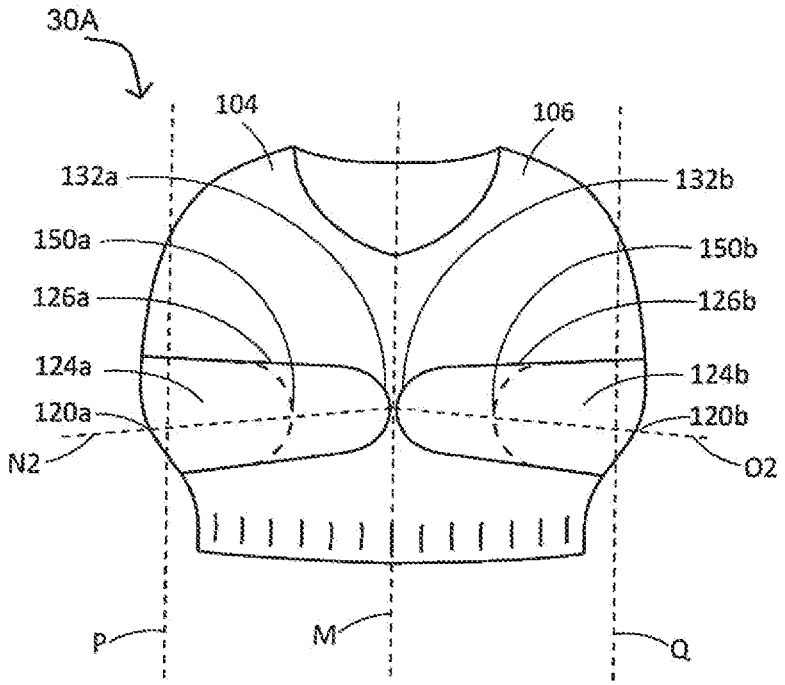
FIG. 39 is a front view of a swaddling garment, in accordance with an aspect of the present invention.

FIG. 39 shows an alternative configuration of the forearm-hand openings 124*a*, 124*b* for a swaddling garment, in which the forearm-hand opening 124*a* begins at the elbow regions 120*a* and extends towards the midline M along the elbow-chest line N2 and ends at the lower chest region 150*a*, and forearm-hand opening 124*b* begins at the elbow regions 120*b* and extends towards the midline M along the elbow-chest line O2 and ends at the lower chest region 150*b*. The elbow-chest lines N2, O2 extends from the elbow regions 120*a*, 120*b* and intersects with the midline M at approximately in-between the lower chest of an infant in the swaddling garment. Thus the aforementioned configuration of FIG. 39 results in the forearm-hand positioners 126*a*, 126*b* extending outwardly (from the forearm-hand openings 124*a*, 124*b*) and towards the midline M along the elbow-chest lines N2, O2 with the forearm-hand positioner tips 132*a*, 132*b* touching together at the midline M at approximately in-between the lower chest of an infant in the swaddling garment, allowing the infant to be swaddled with forearms positioned over the chest and hands touching together at the midline.

Figure 40:
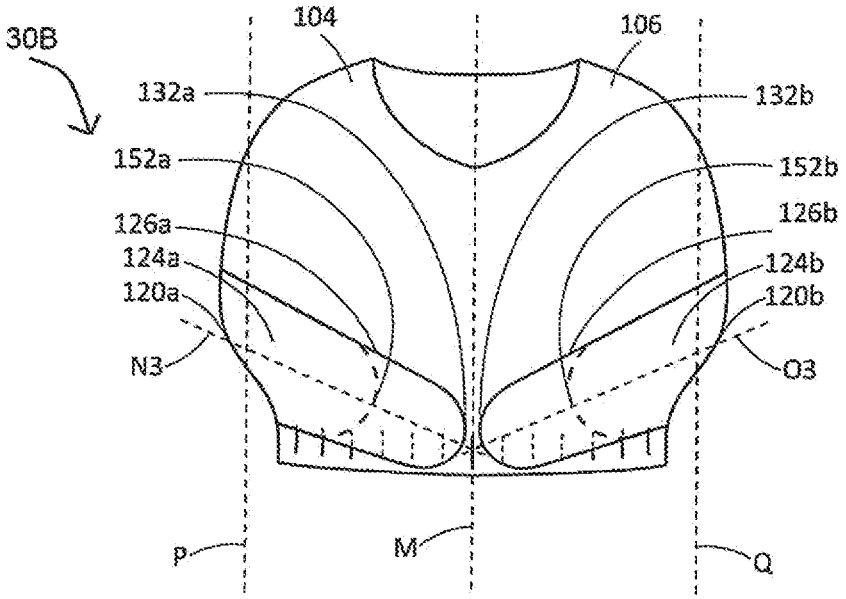
FIG. 40 is a front view of a swaddling garment, in accordance with an aspect of the present invention.

FIG. 40 shows another alternative configuration of the forearm-hand openings 124*a*, 124*b* for a swaddling garment, in which the forearm-hand opening 124*a* begins at the elbow regions 120*a* and extends towards the midline M along the elbow-abdomen line N3 and ends at the upper abdomen region 152*a*, and forearm-hand opening 124*b* begins at the elbow regions 120*b* and extends towards the midline M along the elbow-abdomen line O3 and ends at the upper abdomen region 152*b*. The elbow-abdomen lines N3, O3 extends from the elbow regions 120*a*, 120*b* and intersects with the midline M at approximately centre of the abdomen of an infant in the swaddling garment. Thus the aforementioned configuration of FIG. 5B results in the forearm-hand positioners 126*a*, 126*b* extending outwardly (from the forearm-hand openings 124*a*, 124*b*) and towards the midline M along the elbow-abdomen lines N3, O3 with the forearm-hand positioner tips 132*a*, 132*b* pointing at the midline Mat approximately centre of the abdomen of an infant in the swaddling garment, allowing the infant to be swaddled with forearms positioned over the abdomen and hands touching together at the midline over the abdomen.

Figure 41:
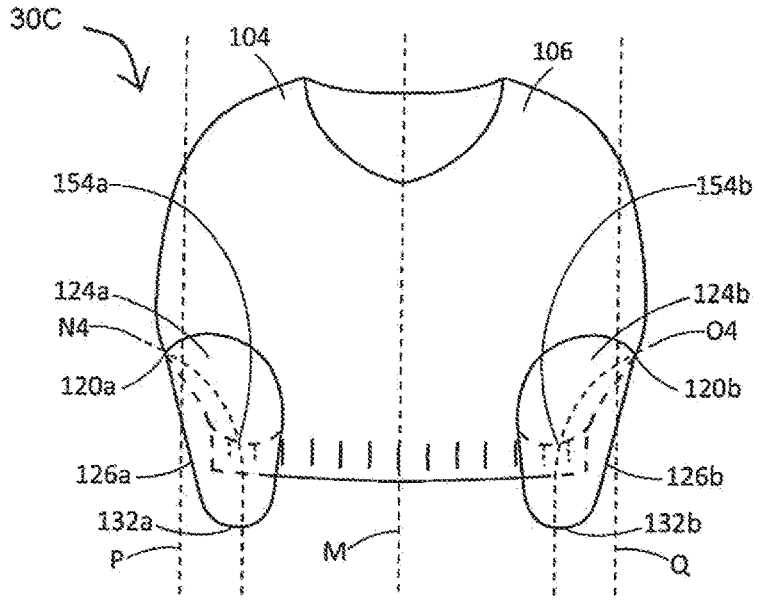
FIG. 41 is a front view of a swaddling garment, in accordance with an aspect of the present invention.

FIG. 41 shows another alternative configuration of the forearm-hand openings 124*a*, 124*b* for a swaddling garment, in which the forearm-hand opening 124*a* begins at the elbow regions 120*a* and extends downwardly along the elbow-feet line N4 and ends at the waist side region 154*a* and forearm-hand opening 124*b* begins at the elbow regions 120*b* and extends downwardly along the elbow-feet line O4 and ends at the waist side region 154*b*. The elbow-feet line N4, O4 extends downwardly from the elbow regions 120*a*, 120*b* and points towards the feet of an infant in the swaddling garment. Thus the aforementioned configuration of FIG. 5C results in the forearm-hand positioners 126*a*, 126*b* extending downwardly (from the forearm-hand openings 124*a*, 124*b*) on the sides of the torso along the elbow-feet line N4, O4 with the forearm-hand positioner tips 132*a*, 132*b* pointing towards the feet of an infant in the swaddling garment, allowing the infant to be swaddled with forearms and hands positioned by the sides of the torso.

Figure 42:
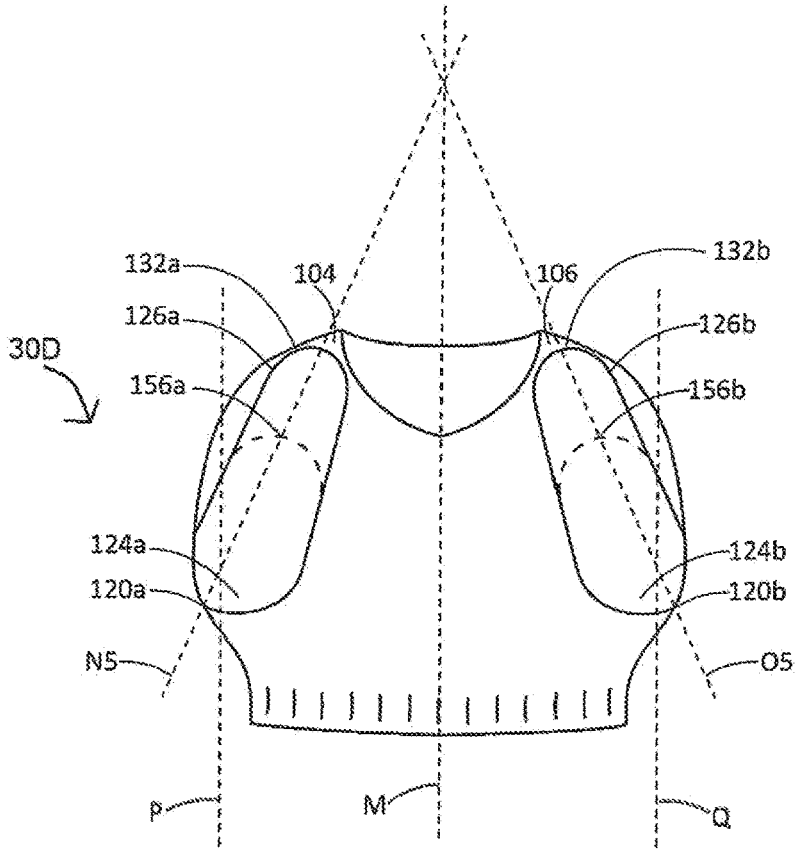
FIG. 42 is a front view of a swaddling garment, in accordance with an aspect of the present invention.

FIG. 42 shows another alternative configuration of the forearm-hand openings 124*a*, 124*b* for a swaddling garment, in which the forearm-hand opening 124*a* begins at the elbow regions 120*a* and extends upwards towards the midline M along the elbow-ear line N5 and ends at the armpit region 156*a* and forearm-hand opening 124*b* begins at the elbow regions 120*b* and extends upwards towards the midline M along the elbow-ear line O5 and ends at the armpit region 156*b*. The elbow-ear line N5, O5 extends from the elbow regions 120*a*, 120*b* and intersects with the midline M at approximately top of the head of an infant in the swaddling garment. Thus the aforementioned configuration of FIG. 5D results in the forearm-hand positioners 126*a*, 126*b* extending outwardly (from the forearm-hand openings 124*a*, 124*b*) and towards the midline M along the elbow-ear line N5, O5 with the forearm-hand positioner tips 132*a*, 132*b* pointing towards the midline M in the direction of the ears of an infant in the swaddling garment, allowing the infant to be swaddled with forearms and hands up and hands positioned next to the sides of the infant's face.

Figure 43:
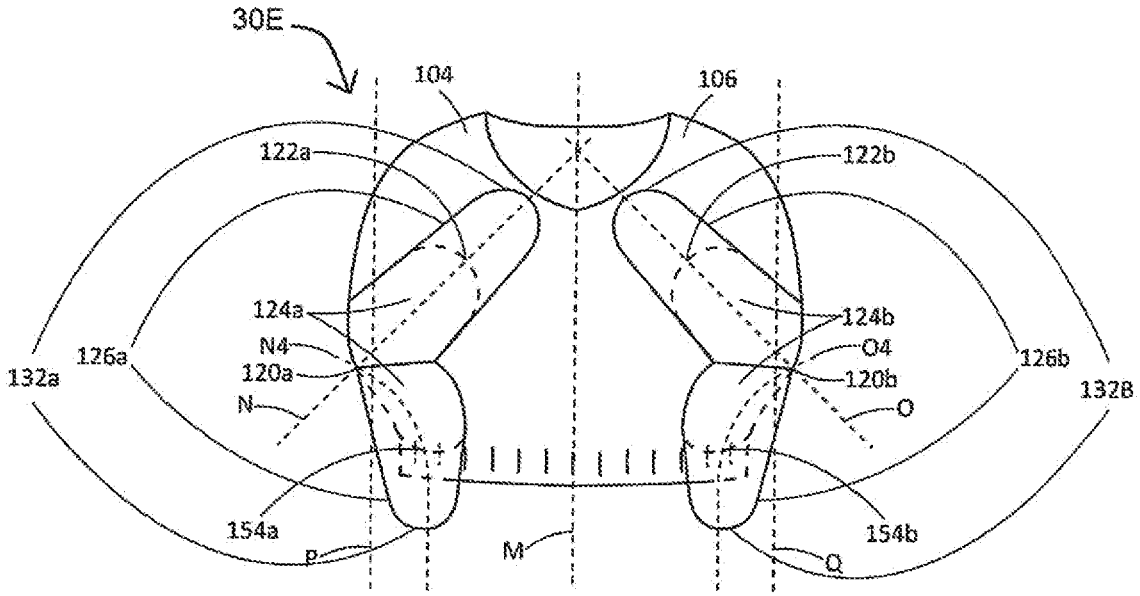
FIG. 43 is a front view of a swaddling garment, in accordance with an aspect of the present invention.

FIG. 43 shows another alternative configuration of the forearm-hand openings 124*a*, 124*b* for a swaddling garment, in which the configurations for the forearm-hand openings 124*a*, 124*b* of FIG. 1 is combined with the configurations for the forearm-hand openings 124*a*, 124*b* of FIGS. 5C, thereby forming a combined forearm-hand openings 124*a*, 124*b* on opposite sides of the front panel 106. Thus the aforementioned configuration of FIG. 5E results in multiple pairs of forearm-hand positioners 126*a*, 126*b* extending from the forearm-hand openings 124*a*, 124*b*, with one pair of forearm-hand positioners 126*a*, 126*b* extending outwardly and towards the midline M along the elbow-mouth line N, O with the forearm-hand positioner tips 132*a*, 132*b* pointing towards the midline M in the direction of the mouth of an infant in the swaddling garment, allowing the infant to be swaddled with forearms and hands positioned up-and-towards the midline of the body near the face or mouth; and with another pair of forearm-hand positioners 126*a*, 126*b* extending downwardly on the sides of the torso along the elbow-feet line N4, O4 with the forearm-hand positioner tips 132*a*, 132*b* pointing towards the feet of an infant in the swaddling garment, allowing the infant to be swaddled with forearms and hands positioned by the sides of the torso.

The configurations of FIGS. 39 to 43 otherwise retains the same features as the embodiment depicted in FIG. 1. In use, the configuration FIG. 39 allows a caretaker to swaddle an infant with forearms positioned over the chest and hands touching together at the midline. In use, the configuration FIG. 40 allows a caretaker to swaddle an infant with forearms positioned over the abdomen and hands touching together at the midline over the abdomen. In use, the configuration FIG. 41 allows a caretaker to swaddle an infant with forearms and hands positioned by the sides of the torso.

The configurations of FIGS. 39 to 41 provide progressively more restrictive swaddling of the infant's arms, with the configuration of FIG. 39 being the least restrictive and the configurations of FIG. 41 being the most restrictive in the group, thereby provides the following additional advantages:

a) A more restrictive swaddling of the arms may be required to help calm an infant in the following scenarios:
   i. During early stage after birth, when there is a relative discontinuation of the infant's exploratory and goal directed behaviour and lack of motor control, due to environmental changes.
   ii. During periods of sleep regressions due to illnesses, teething, growth spurts etc.
   iii. Some infants calm easier with more restrictive swaddling of the arms, which may be due to individual preference or presence of stronger startle reflex.
   iv. Some infants who are still learning to control the movement of their hands can be prone to poking themselves in the eye, or slapping themselves in the face, keeping them from falling asleep, and this is happening even while their hands are covered.
   v. Some infants have tendencies to scratch their face and head. This is especially problematic if the infant has eczema. While covering their hands can generally help prevent the scratching and minimise eczema flair ups, this may not be the case with every infant.

b) Although the garment of FIG. 1 can also be used with the infant's forearms and hands completely enclosed within the front panel 106 to provide more restrictive swaddling of the infant's arms, the configurations of FIGS. 39 to 41 provides a more secure method to maintain the infant's forearms and hands in a specific position which may be required for some infants.

In use, the configuration shown in FIG. 42 allows a caretaker to swaddle an infant with forearms and hands up and hands positioned next to the sides of the infant's face, which is a variation of the 'fetal-hand position' preferred by and therefore advantageous for some infants.

In use, the configuration FIG. 43 allows a caretaker to selectively swaddle an infant with forearms and hands positioned either 'up-and-towards the midline of the body near the face or mouth' or 'by the sides of the torso', thereby may provide the following additional advantages:

a) Provides easier transition of the infant from the womb environment to the outside environment.
b) The multiple forearms and hands positioning allows the swaddling garment to be used throughout infant's changing needs, providing further versatility and cost saving.
c) Provides additional means for caretakers to swaddle an infant as per the infant's individual needs, development stage or preference.

Various alternative embodiments of the front panel may be provided (not shown). The front panel may be divided vertically into two minor front sides as to form a main opening along the midline. he main opening 172 can be selectively opened or closed by a releasable fastening mechanism Preferably releasable fastening mechanism 174 is a zipper but it may be any suitable fastening mechanism, such as but not limited to various types of: zippers, hook and loop fastener, snaps, buttons, draw strings, tie strings, clasps, wraps, straps, magnets, like fasteners, or a combination thereof.

In another alternative embodiment of the front panel 106 for a swaddling garment, the minor front panels may be formed in a shape of a cardigan and the releasable fastening mechanism may include two columns of snaps or buttons minor front panels, thereby allowing the swaddling garment to be easily worn over other heavier garments and allowing the caretaker to additionally adjust the tightness of the swaddling garment as per the infant's requirement.

In another alternative embodiment of the minor front panels may be formed in a shape of a kimono overlapping each other and the releasable fastening mechanism is a set of hook and loop fasteners at each waist side regions, thereby providing additional warmth and comfort for the infant in the swaddling garment.

FIGS. 44 to 47 show various alternative embodiments of a swaddling garment 40 are shown; in which the swaddling garment includes the same upper section 102 for receiving and supporting an infant's upper-body and upper-limbs as shown in FIG. 1. These further embodiments further includes a lower section 200 which may include any suitable 'elements, features, or structures' for receiving and enclosing (either partially or fully) an infant's lower-body and lower-limbs.

Figure 44:
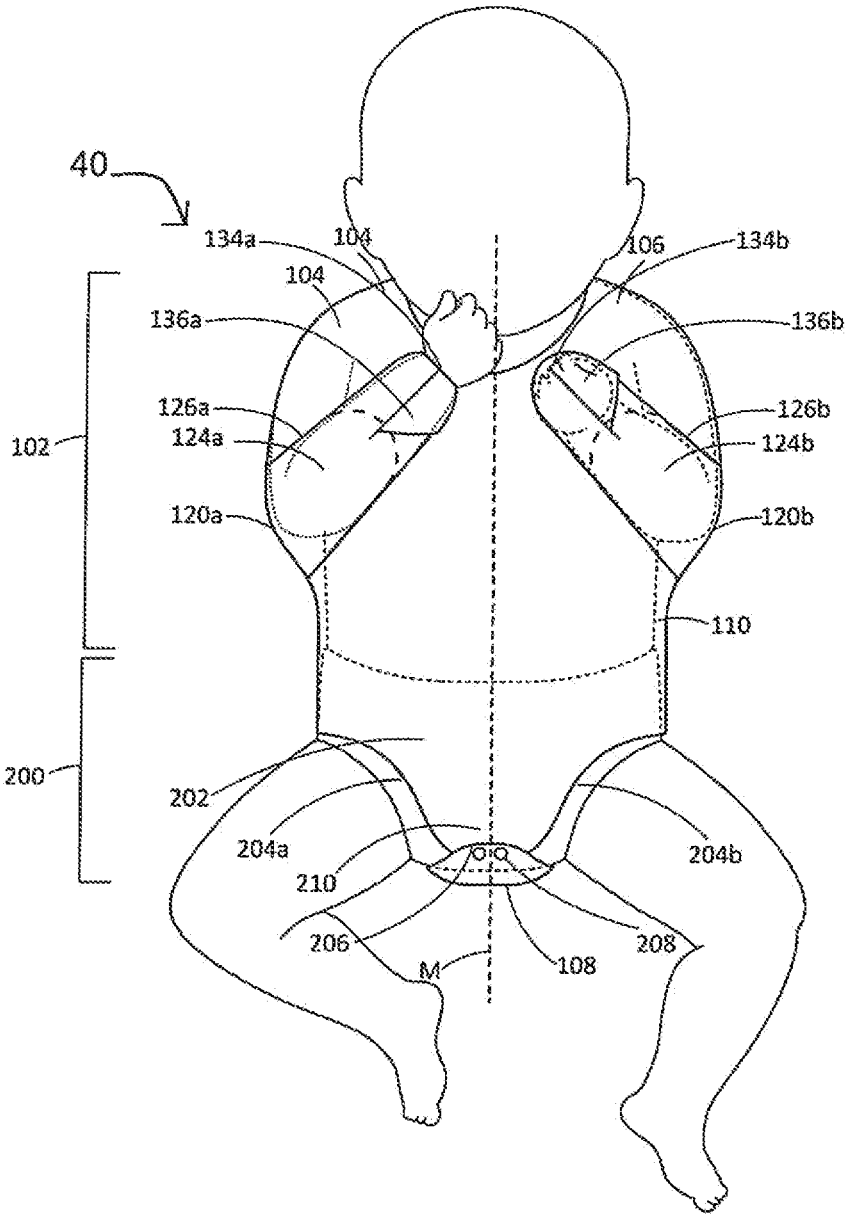
FIG. 44 is a front schematic view of a of an infant swaddled in a swaddling garment, in accordance with an aspect of the present invention.

In FIG. 44 the swaddling garment includes lower section 200 having a lower-torso portion 202 for receiving and enclosing an infant's lower torso. Lower-torso portion 202 is formed continuously with the shell portion 104 and includes leg openings 204*a*, 204*b* through which the infant's legs may extend out, and a crotch opening 206 (at the lowermost periphery below the crotch region 210) which selectively secures the front panel 106 to the rear panel 108 by a crotch fastening mechanism 208. Preferably crotch fastening mechanism 208 is a set of snaps but it may be any suitable fastening mechanism.

The embodiment of FIG. 44 otherwise retains the same features as the embodiment depicted in FIGS. 1 and 20

The garment of FIG. 44 can be used in a similar manner to the garment of FIGS. 1 and 20, thereby providing the same advantages.

The garment of FIG. 44 however differs in that, in use, a caregiver slides or pulls the swaddling garment over the infant's head, then places infant's forearms and hands in each respective forearm-hand positioners 126*a*, 126*b*, then the crotch opening 206 is pulled down to the lowermost periphery below the crotch region 210, then with the infant's legs extended out from the leg openings 204*a*, 204*b* the crotch opening 206 is selectively secured over the crotch by a crotch fastening mechanism 208. The embodiment of FIG. 44 may provide the following additional advantages to that of embodiment of FIGS. 1 and 20:

a) Anchors the swaddling garment over the infant's crotch, providing a more secure method to prevent the swaddling garment from riding up the infant's body; thereby eliminating the risk of strangulation and suffocation due to loose fabric, and of the infant's torso being exposed, while still facilitating easy nappy/diaper access and allowing the caregiver to check or change the infant's nappy/diaper without waking or disturbing the infant.
b) Covers the infant's lower torso, providing additional warmth for cooler ambient temperatures or weather.

FIGS. 45 to 49, another alternative embodiment of a swaddling garment 50 is shown, in which the lower section 200 includes a pouch portion, or bag portion, or sack portion 300 for receiving and enclosing an infant's lower-body and legs. Sack portion 300 is formed continuously with the shell portion 104, continuing downwards from the waist region 110 forming a bell shaped front panel 106 and rear panel 108.

The front panel 106 is divided vertically into two minor front panels 170*a*, 170*b* thereby forming a main opening 172 along the midline M. The main opening 172 can be selectively opened or closed by a releasable fastening mechanism 174. The releasable fastening mechanism 174 may be any suitable fastening mechanism, such as but not limited to various types of: zippers, hook and loop fastener, snaps, buttons, draw strings, tie strings, clasps, wraps, straps, magnets, like fasteners, or a combination thereof. Preferably the releasable fastening mechanism 174 is a two-way zipper including a top zipper slider 302 and a bottom zipper slider 304, which allows full opening of the main opening 172 from the top end (allowing the caretaker to selectively open and close the swaddling garment to 'place or retain the infant inside' or to 'remove the infant from' the swaddling garment) and partial opening of the main opening 172 from the bottom end (allowing the caretaker to access the infant's lower body).

The rear panel 108 includes a harness opening 306 to receive a child safety harness while partial opening of the main opening 172 from the bottom end allows the child safety harness to pass through the entirety of the swaddling garment, allowing the infant to be secured to a car seat or a stroller whilst remaining in the swaddling garment.

The embodiment of FIGS. 45 to 49 otherwise retains the same features as the embodiment depicted in FIGS. 1 and 20.

The embodiment of FIGS. 45 to 49 can be used in a similar manner to the embodiment of FIGS. 1 and 20, thereby providing the same advantages.

Figure 49:
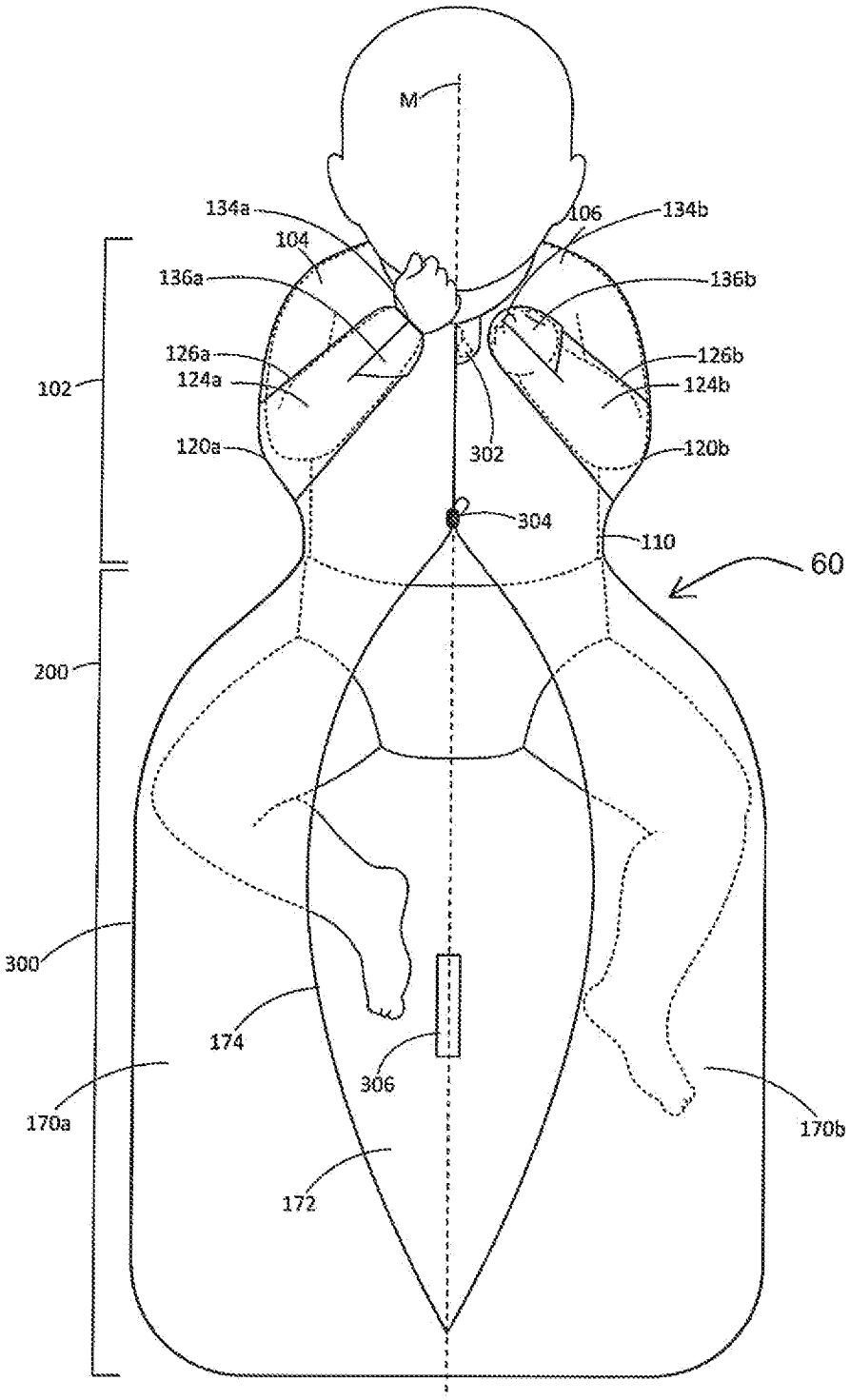
FIG. 49 is a schematic view of the garment as shown in FIG. 44 within the sack portion, and the main opening partially open, in accordance with an aspect of the present invention.

The embodiment of FIGS. 45 to 49 however differs in that, in use, a caregiver selectively opens the main opening 172 by pulling the top zipper slider 302 (FIG. 47) downwards, then places the infant's body and limbs inside the swaddling garment with the infant's forearms and hands placed in each respective forearm-hand positioners 126*a*, 126*b*, then closes the main opening 172 by pulling the top zipper slider 302 upwards, enclosing the infant's entire body from the neck down and all four limbs (FIG. 49) within the swaddling garment. The caretaker can selectively open the main opening 172 partially by pulling the bottom zipper slider 304 upwards, for checking on infant's temperature, checking or changing nappy/diaper, or for using the child safety harness in a car or a stroller, whilst the infant remain sufficiently swaddled (FIG. 49).

The embodiment of FIGS. 44 to 49 thereby provides the following additional advantages to that of embodiment of FIGS. 1 and 20:

a) Allows the caretaker to selectively open and close the swaddling garment to 'place or retain the infant inside' or to 'remove the infant from' the swaddling garment with speed and ease; which is especially helpful when the caretaker needs to swaddle an infant during the middle of the night, or quickly swaddle or unswaddle an infant who is being fussy or isn't feeling well to avoid overstimulating the infant.

b) Completely covers the infant's lower torso and limbs, providing additional warmth for cooler ambient temperatures or weather. The swaddling garment can be made of any suitable material of varying warmth or thickness, to accommodate swaddling of an infant throughout all seasons and ambient temperatures.

c) The fully enclosed environment of the swaddling garment may provide the infant with additional feeling of being enclosed in the comforting and secure environment of the womb, thereby further helping in soothing the infant.

d) Even though the lower body is fully enclosed the garment still:

i. Facilitates easy nappy/diaper access and allows the caregiver to check or change the infant's nappy/diaper whilst the infant remain sufficiently swaddled and without waking or disturbing the infant).

ii. Provides additional method for reducing the risk of overheating, as during warmer temperatures the bottom half of the releasable fastening mechanism 174 can be left open by pulling up on the bottom zipper slider 304 to provide an open ventilation for air to circulate).

iii. Can be worn with or over other garments, such as, warm infant sleeping bags, pyjamas, bodysuits or any suitable clothing items, in cooler seasons and ambient temperatures.

iv. May reduce or eliminate the risks of hip dysplasia as hips are free to move and knees free to bend in the fetal position, by virtue of the bell shaped design which provides ample room and does not restrict the hips and legs of the infant.

v. Can be configured with a wider sack portion 300 to for use with any type of hip brace or hip harness.

vi. Able to use with a child safety harness, such as a five point harness, for travelling in a car or a stroller.

e) With the lower-body and lower-limbs fully enclosed, the infant is able to feel the texture of the fabric against the skin of lower-body and lower-limbs, providing additional tactile stimulation to further help soothe the infant and help with the infant's sensory development as well.

f) The infant is also able to kick his/her legs against the resistance of the swaddling garment further helping developing muscles and improving motor skills.

g) With the lower-body and lower-limbs fully enclosed, and the kicking of the legs, helps further in anchoring and preventing the swaddling garment from riding up the infant's body.

Figure 50:
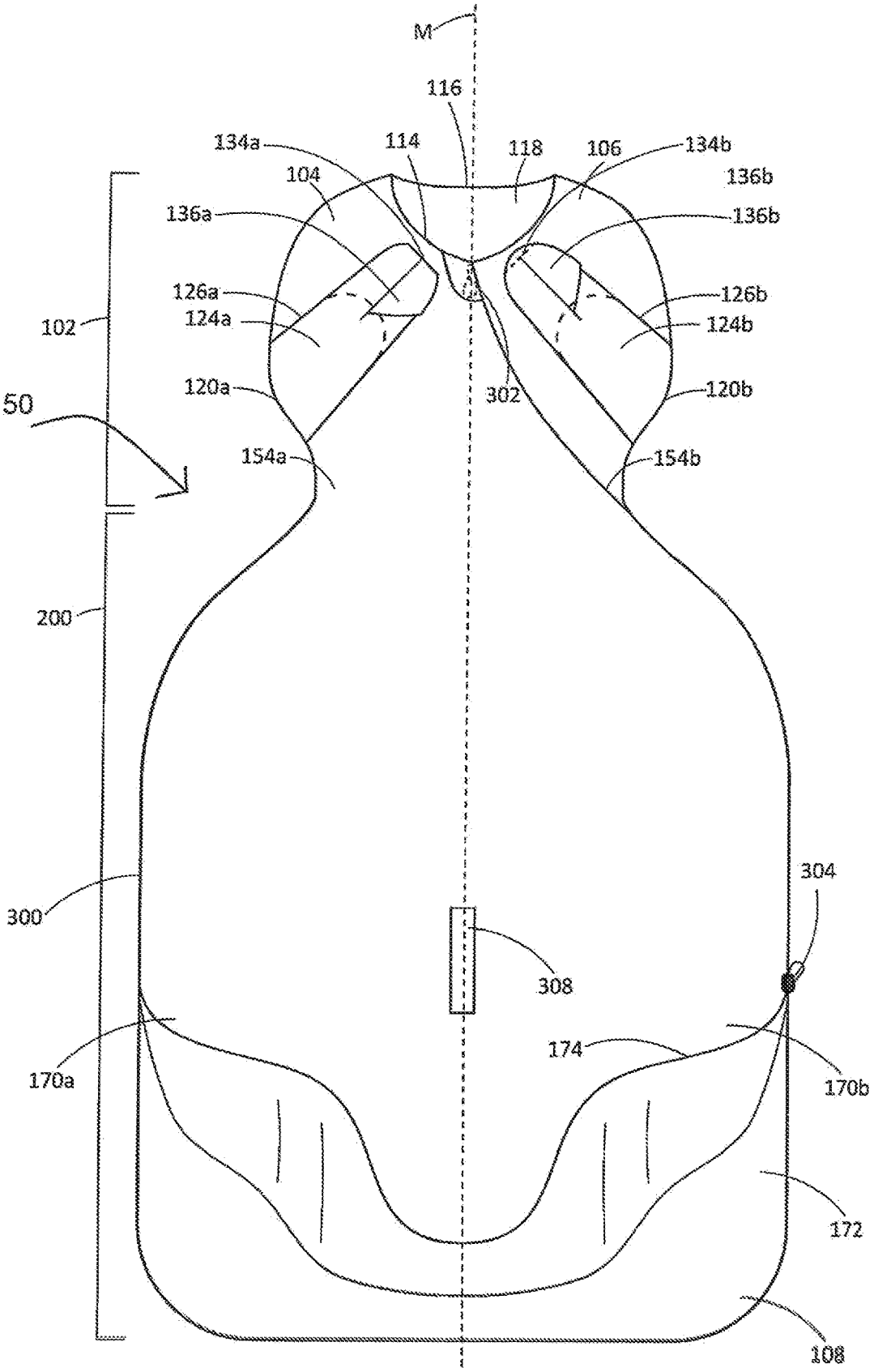
FIG. 50 show an alternative variation of the embodiment of FIG. 49, in accordance with an aspect of the present invention.

In an alternative variation of the embodiment of FIGS. 44 to 49 is shown in FIG. 50. In this garment 50, the front panel 106 includes a main opening 172, beginning at the point where the midline M intersects with the front neckline 114, and extending downwards and across towards the waist side region 154*b* (alternatively may extend towards the opposite waist side region 154*a*), then extending downwards and around from the left side edge of the sack portion 300 to the opposite side edge (as depicted in FIG. 50). The main opening 172 may follow a straight, curved or sinuous line from beginning point to the waist side region 154*b*.

The main opening 172 can be selectively opened or closed by a releasable fastening mechanism 174. The releasable fastening mechanism 174 may be any suitable fastening mechanism, such as but not limited to various types of: zippers, hook and loop fastener, snaps, buttons, draw strings, tie strings, clasps, wraps, straps, magnets, like fasteners, or a combination thereof. Preferably the releasable fastening mechanism 174 is a two-way zipper including a top zipper slider 302 and a bottom zipper slider 304, which allows full opening of the main opening 172 from the top end (allowing the caretaker to selectively open and close the swaddling garment to 'place or retain the infant inside' or to 'remove the infant from' the swaddling garment) and partial opening of the main opening 172 from the bottom end (allowing the caretaker to access the infant's lower body).

The rear panel 108 includes a harness opening 306 to receive a child safety harness, and the front panel 106 includes a front harness opening 308 to allow the child safely harness to pass through the swaddling garment, thereby allowing the infant to be secured to a car seat or a stroller whilst remaining in the swaddling garment.

Figure 45:
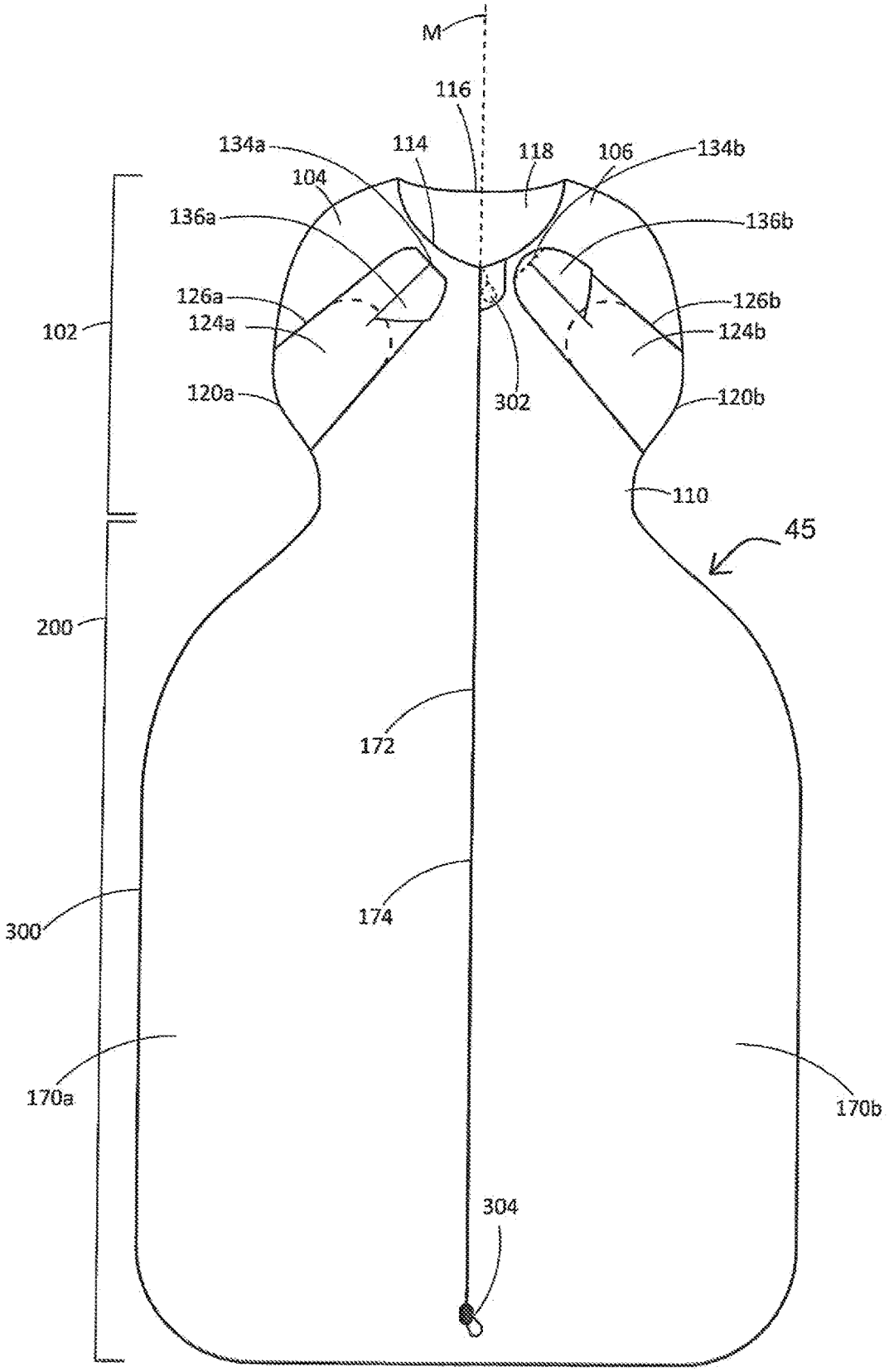
FIG. 45 is a front view of a swaddling garment, in accordance with an aspect of the present invention.
Figure 46:
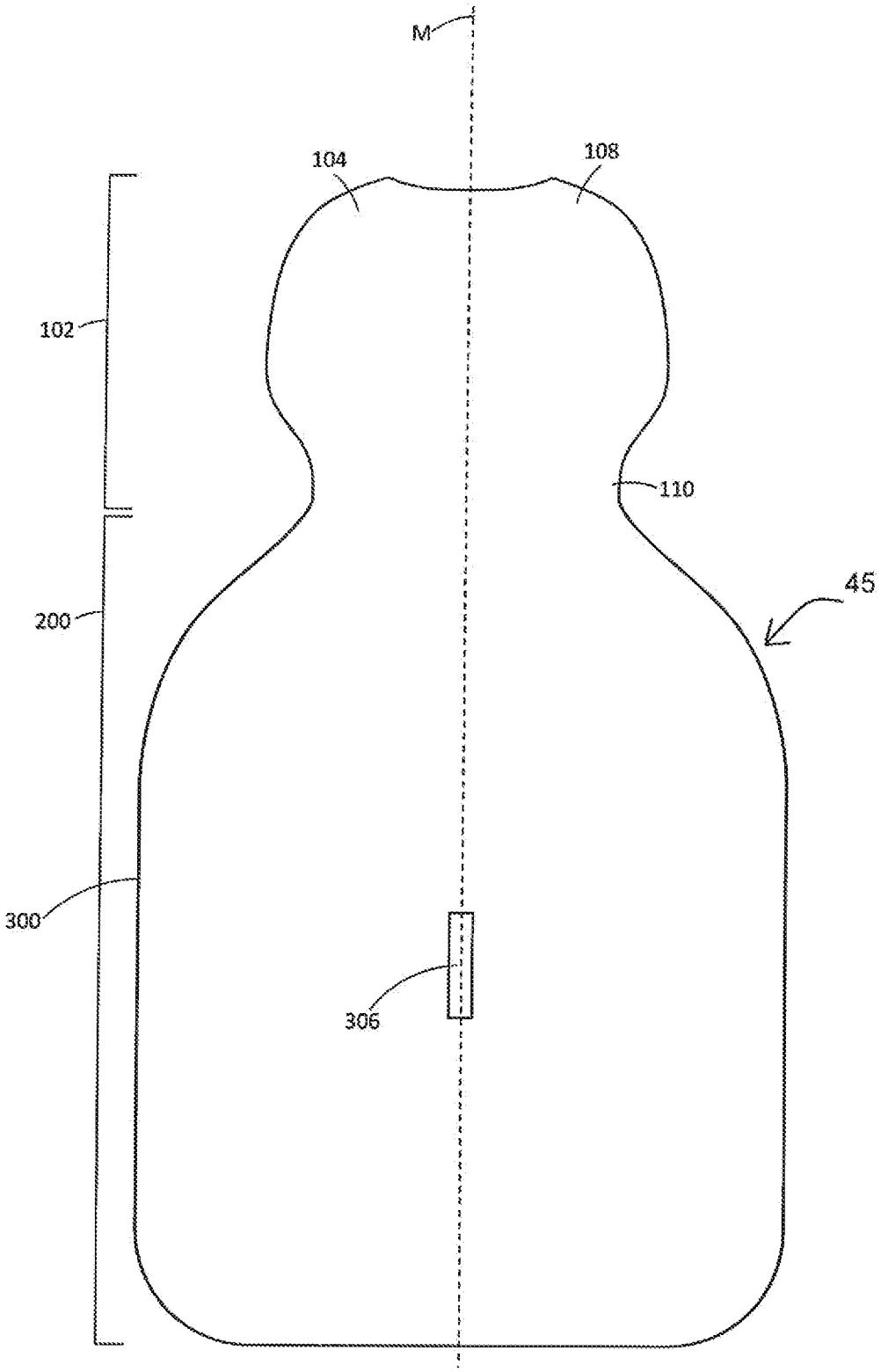
FIG. 46 is a back view of a swaddling garment as shown in FIG. 45, in accordance with an aspect of the present invention.
Figure 47:
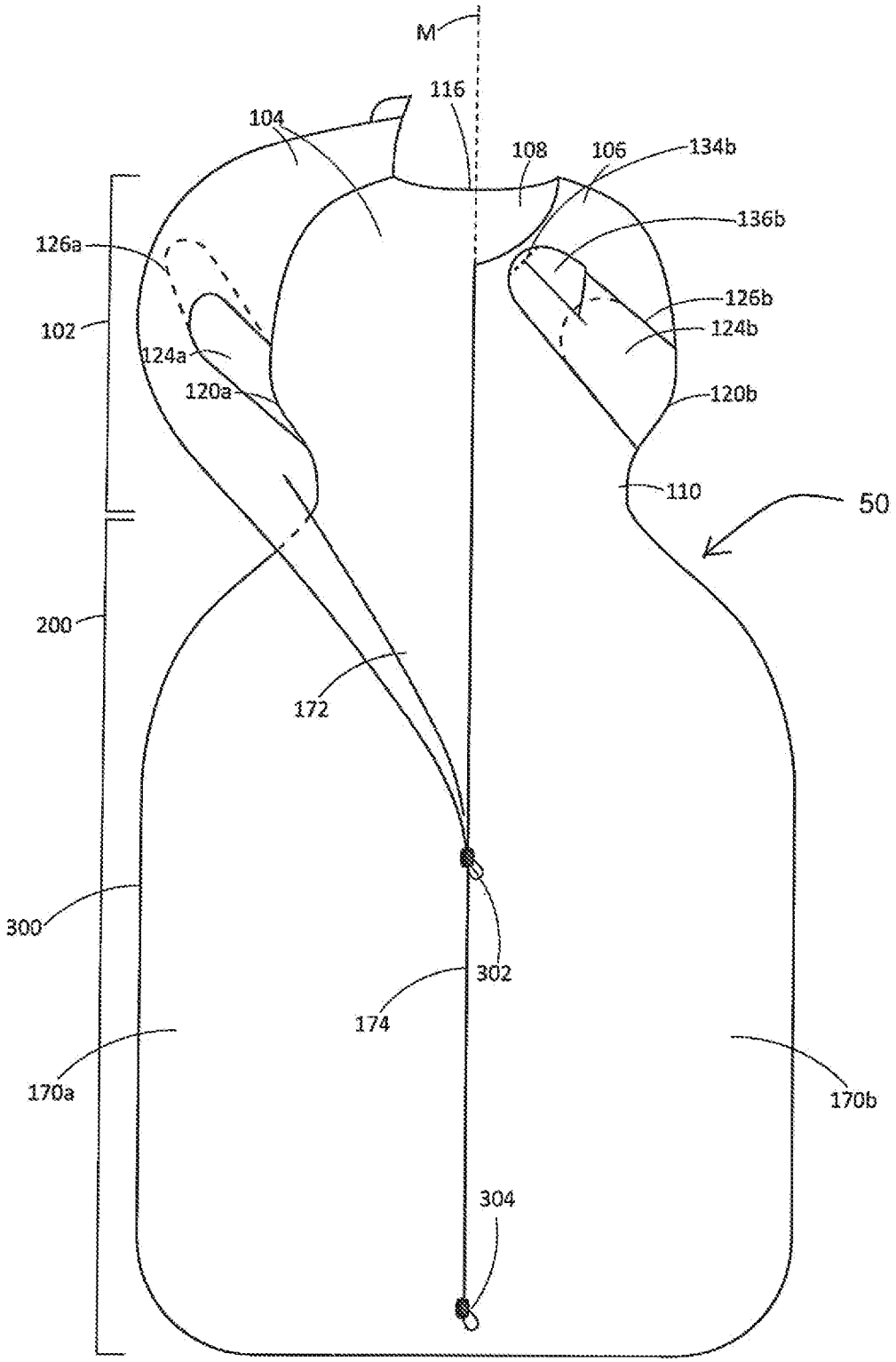
FIG. 47 shows the front view as shown in FIG. 45, with the main opening partially opened on one side, in accordance with an aspect of the present invention.
Figure 48:
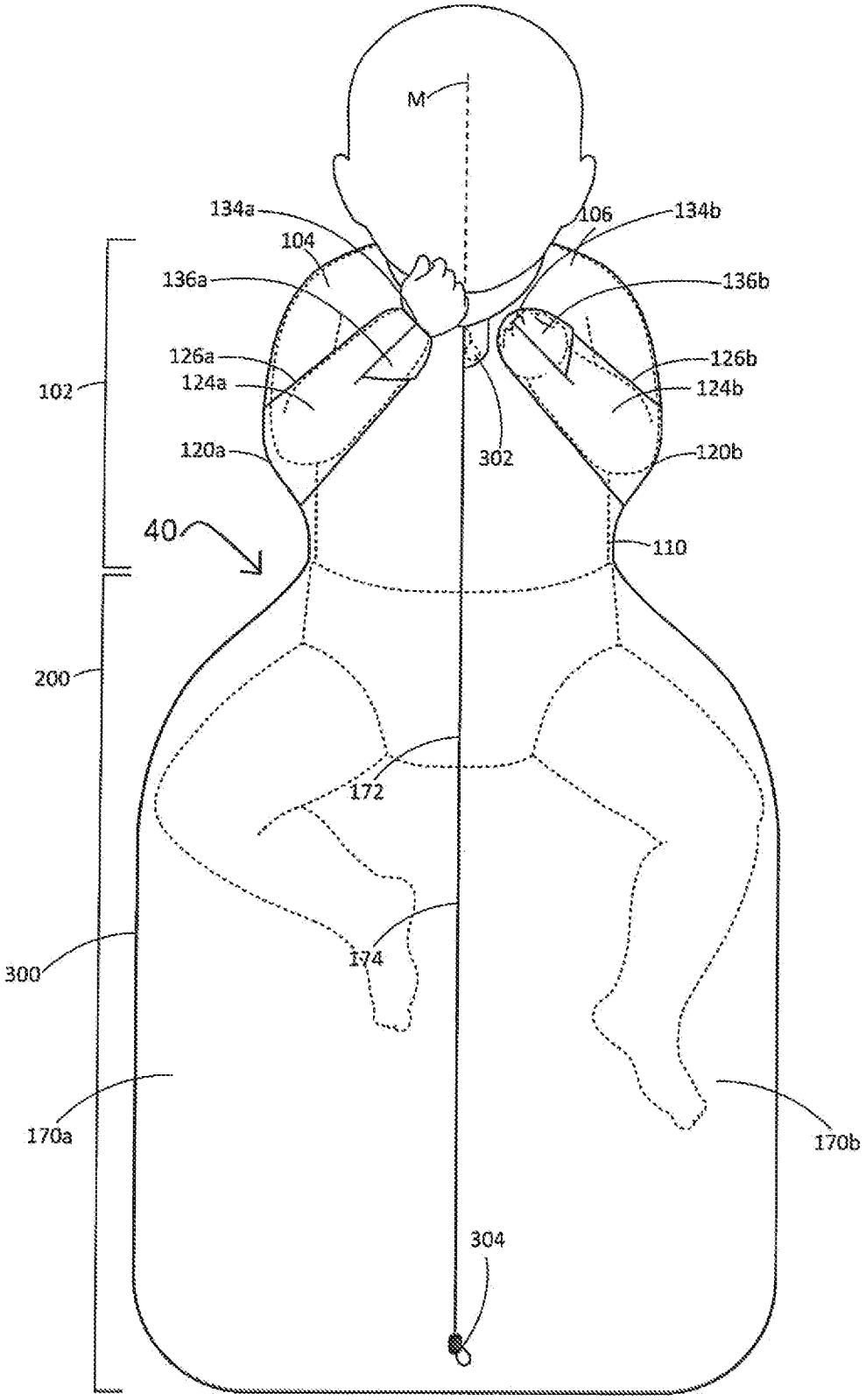
FIG. 48 is a schematic view of the garment as shown in FIGS. 40, 41 and 42 with an infant swaddled therein, in accordance with an aspect of the present invention.

The embodiment of FIG. 50 otherwise retains the same features as the embodiment depicted in FIG. 45. The embodiment of FIG. 50 can be used in a similar manner to the embodiment of FIG. 45, thereby providing the same advantages as that of embodiment of FIG. 45.

The embodiment of FIG. 50 however differs in that, in use, the main opening 172 can be opened much wider and when fully opened, the sack portion 300 lays completely flat, thereby provides the following additional advantages to that of embodiment of FIG. 45:

a) Provides an easier option for active infants to be placed or removed from the swaddling garment, due to the swaddling garment having a wider opening.

b) Allows the caregiver to check or change the infant's nappy/diaper without having to remove the infant's legs from the bottom of the swaddling garment further minimising the risk of waking or disturbing the infant.

Figure 51:
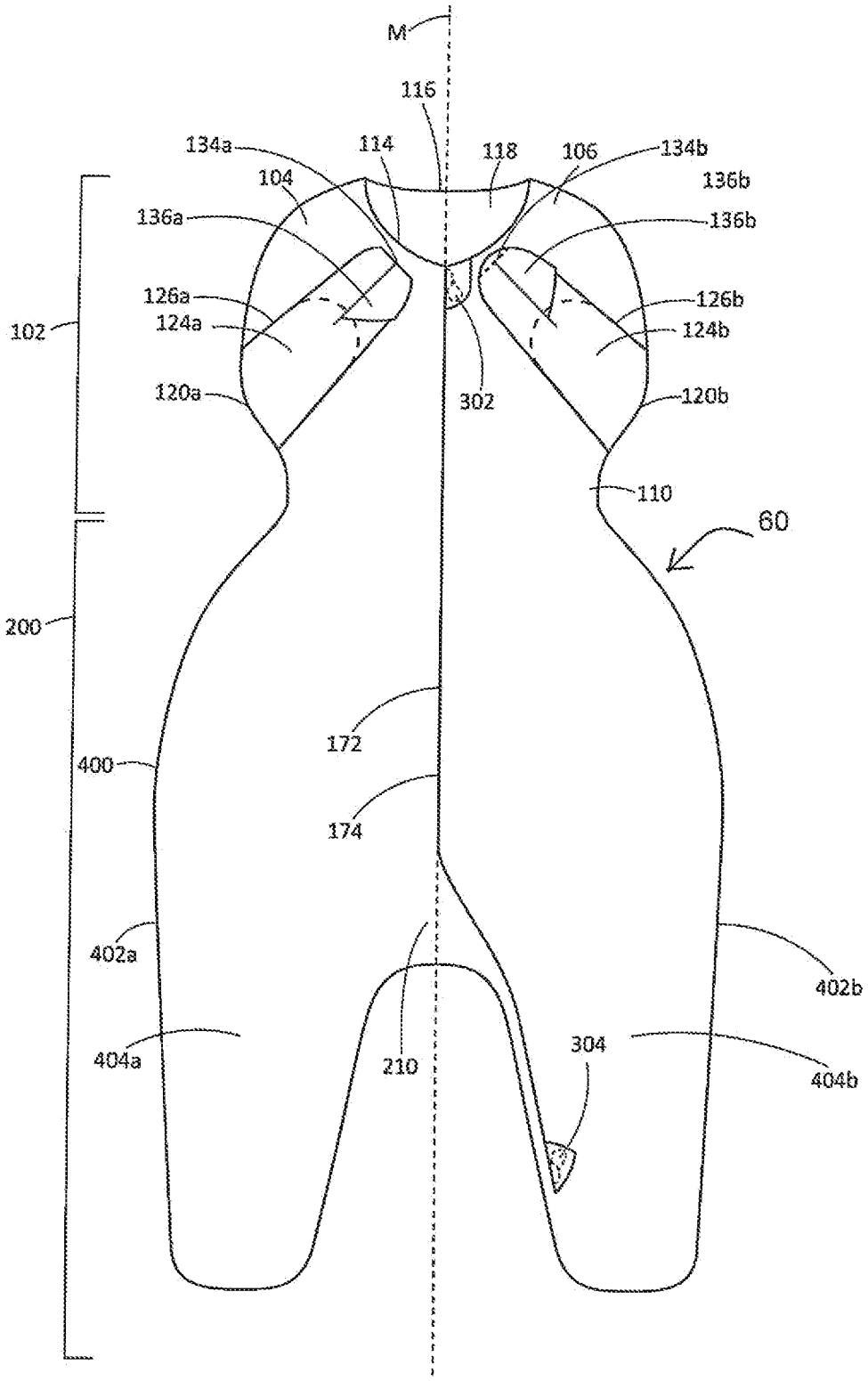
FIGS. 51 and 52 show front and rear views another alternative embodiment of a swaddling garment with a shell portion and a continuous leg portion, or pant portion, or trouser portion, in accordance with an aspect of the present invention.

Referring to FIG. 51, another alternative embodiment of a swaddling garment 60 is shown, in which the lower section 200 includes a leg portion, or pant portion, or trouser portion 400 for receiving and enclosing an infant's lower-body and legs. The trouser portion 400 includes a crotch region 210 and two trouser legs 402*a*, 402*b* on each side, with trouser leg 402*a* including a knee region 404*a* and trouser leg 402*b* including a knee region 404*b*. Trouser portion 400 is formed continuously with the shell portion 104, continuing downwards from the waist region 110 forming a 'one-piece suit' shaped front panel 106 and rear panel 108). The front panel 106 includes a main opening 172 beginning at the point where the midline M intersects with the front neckline 114 and extending downwards along the midline M, then from the crotch region 210 veering towards trouser leg 402*b*, and ending below the knee region 404*b*. Alternatively the main opening 172 may veer towards the trouser leg 402*a* ending below the knee region 404*a*. The main opening 172 can be selectively opened or closed by a releasable fastening mechanism 174. The releasable fastening mechanism 174 may be any suitable fastening mechanism, such as but not limited to various types of: zippers, hook and loop fastener, snaps, buttons, draw strings, tie strings, clasps, wraps, straps, magnets, like fasteners, or a combination thereof. Preferably the releasable fastening mechanism 174 is a two-way zipper including a top zipper slider 302 and a bottom zipper slider 304, which allows full opening of the main opening 172 from the top end (allowing the caretaker to selectively open and close the swaddling garment to 'place or retain the infant inside' or to 'remove the infant from' the swaddling garment) and partial opening of the main opening 172 from the bottom end (allowing the caretaker to access the infant's lower body).

The embodiment of FIG. 51 otherwise retains the same features as the embodiment depicted in FIGS. 1 and 20. The embodiment of FIG. 50 can be used in a similar manner to the embodiment of FIGS. 1 and 20 thereby providing the same advantages.

The embodiment of FIGS. 50 and 51 however differs in that, in use, a caregiver selectively opens the main opening 172 by pulling the top zipper slider 302 downwards, then places the infant's body and limbs inside the swaddling garment with the infant's forearms and hands placed in each respective forearm-hand positioners 126*a*, 126*b* and infant's legs placed inside each respective trouser legs 402*a*, 402*b*, then closes the main opening 172 by pulling the top zipper slider 302 upwards, enclosing the infant's entire body from the neck down and all four limbs within the swaddling garment while allowing free leg movements. The caretaker can selectively open the main opening 172 partially by pulling the bottom zipper slider 304 upwards, for checking infant's temperature and checking or changing nappy/diaper, whilst the infant remain sufficiently swaddled.

Figure 52:
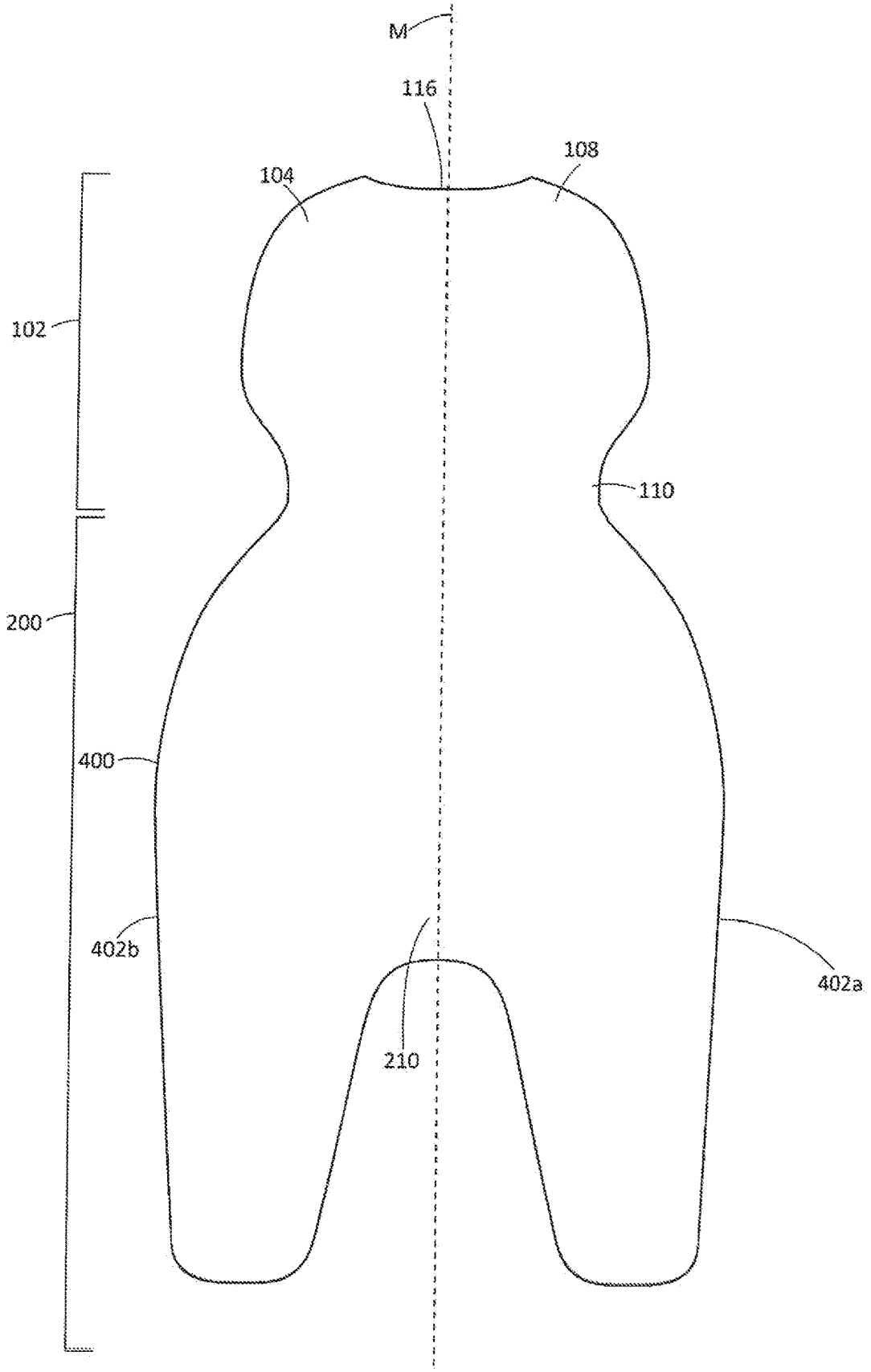

The embodiment of FIGS. 50 and 51 thereby provides the following additional advantages to that of embodiment of FIGS. 1 and 2:

a) Allows the caretaker to selectively open and close the swaddling garment to 'place or retain the infant inside' or to 'remove the infant from' the swaddling garment with speed and ease; which is especially helpful when the caretaker needs to swaddle an infant during the middle of the night, or quickly swaddle or unswaddle an infant who is being fussy or isn't feeling well to avoid overstimulating the infant.

b) Completely covers the infant's lower torso and limbs, providing additional warmth for cooler ambient temperatures or weather. The swaddling garment can be made of any suitable material of varying warmth or thickness, to accommodate swaddling of an infant throughout all seasons and ambient temperatures.

c) The fully enclosed environment of the swaddling garment provides the infant with additional feeling of being enclosed in the comforting and secure environment of the womb, thereby further helping in soothing the infant.

d) Even though the lower body is fully enclosed the embodiment of FIGS. 51 and 52 still:

i. Facilitates easy nappy/diaper access and allows the caregiver to check or change the infant's nappy/diaper without waking or disturbing the infant, by virtue of the two-way zipper releasable fastening mechanism 174 being used.

ii. Provides additional method for reducing the risk of overheating, as during warmer temperatures the bottom half of the releasable fastening mechanism 174 can be left open by pulling up on the bottom zipper slider 304 to provide open ventilation for air to circulate.

iii. Can be worn with or over other garments, such as, pyjamas, bodysuits or any suitable clothing items, in cooler seasons and ambient temperatures.

iv. Eliminates the risks of hip dysplasia as hips are free to move and knees free to bend in the fetal position, by virtue of the 'one-piece suit' design.

v. Able to use with a child safety harness, such as a five point harness, for travelling in a car or a stroller.

e) With the lower-body and lower-limbs fully enclosed, the infant is able to feel the texture of the fabric against the skin of lower-body and lower-limbs, providing additional tactile stimulation to further help soothe the infant and help with the infant's sensory development as well.

f) The infant is also able to kick his/her legs against the resistance of the swaddling garment further helping developing muscles and improving motor skills.

g) With the lower-body and lower-limbs fully enclosed, and the kicking of the legs, helps further in anchoring and preventing the swaddling garment from riding up the infant's body.

h) The 'one-piece suit' design allows free leg movement (which is preferred by some advanced and active infants).

i) Being able to move legs freely is also proffered for older children and adults, particularly but not limited to those with special needs.

Figure 53:
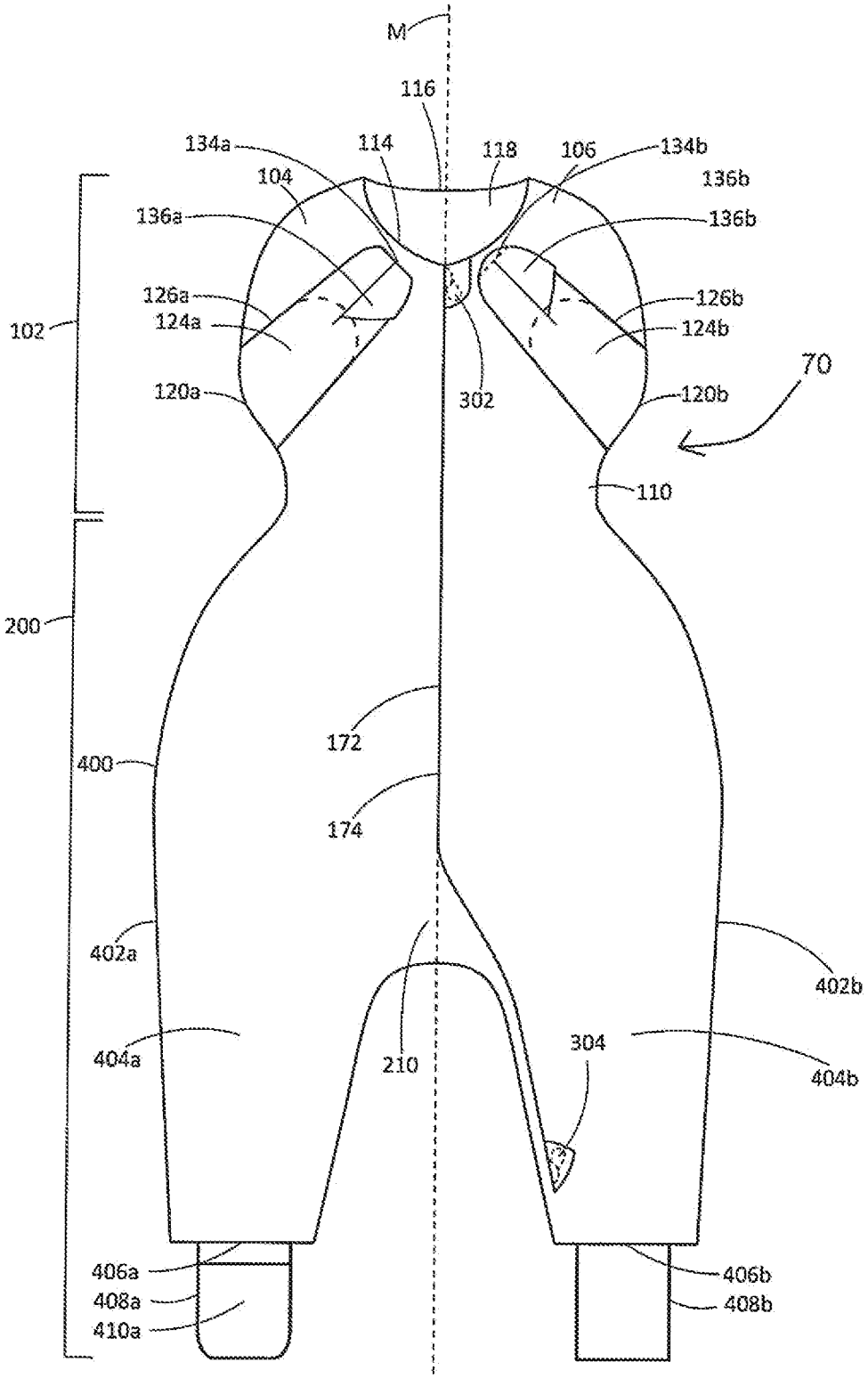
FIGS. 53 and 54 show front and rear views of a still further variation of a swaddling garment, in accordance with an aspect of the present invention.
Figure 54:
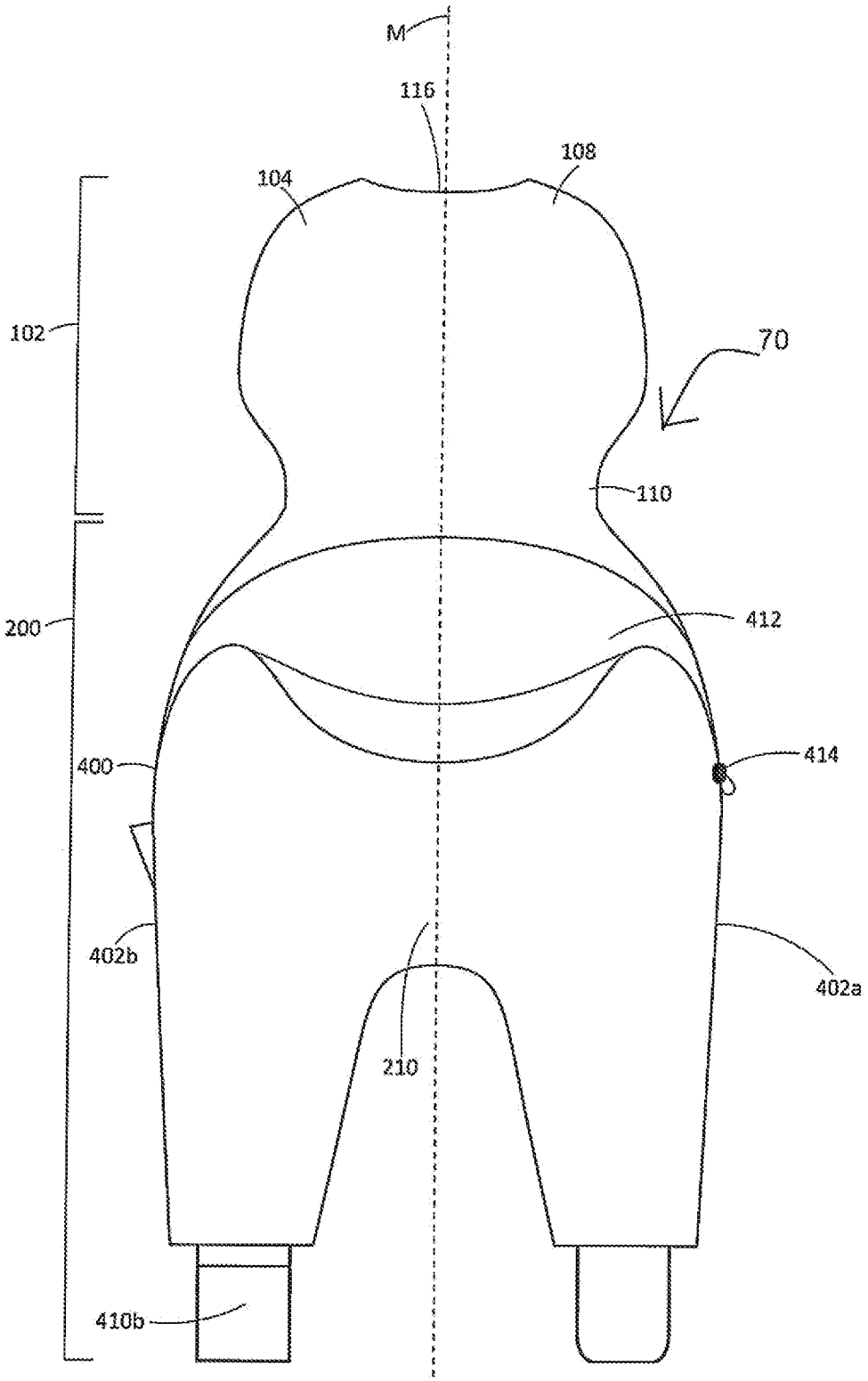

Referring to FIGS. 53 and 54, an alternative garment 70 that is a variation of the embodiment of FIGS. 51 and 52 shown, in which the trouser legs 402*a*, 402*a* at its lowermost periphery includes feet openings 406*a*, 406*b* through which the infant's feet may extend out. Feet openings 406*a*, 406*b* may be loose fitting or made of elasticised material and sized to fit the circumference of the infant's ankles. A pair of ankle cuffs 408*a*, 408*b* may extend outwards from respective feet openings 406*a*, 406*b*. Ankle cuffs 408*a*, 408*b* may be sized to fit the circumference of the infant's ankles and may include a pair of fold-over feet mittens 410*a*, 410*b* which can be selectively folded between an 'open or closed' position to 'uncover or cover' the infant's feet. FIG. 52 shows fold-over feet mitten 410*a* in a closed position and Figure show fold-over feet mitten 410*b* in an open position.

The rear panel 108 may include a drop-seat opening 412 allowing the caretaker to access the infant's lower body from the back. The drop-seat opening 412 includes a drop-seat fastening mechanism 414 to enable selective opening and closing of the drop-seat opening 412 (as depicted in FIG. 53). Preferably drop-seat fastening mechanism 414 is a zipper but it may be any suitable fastening mechanism, such as but not limited to various types of: zippers, hook and loop fastener, snaps, buttons, draw strings, tie strings, clasps, wraps, straps, magnets, like fasteners, or a combination thereof.

The embodiment of FIGS. 53 and 54, otherwise retains the same features as the embodiment depicted in FIGS. 53 and 54.

The embodiment of FIGS. 10C-D can be used in a similar manner to the embodiment of FIG. 10A-B, thereby providing the same advantages as that of embodiment of FIG. 10A-B.

The embodiment FIGS. 53 and 54 however provides the following additional advantages to that of embodiment of FIGS. 51 and 52:

a) Allows the caregiver to selectively uncover the infant's feet for play time, facilitating further tactile stimulation of the feet, which helps in improving infant's sensory and motor development.

b) Allows the caregiver to selectively cover the infant's feet keep them warm, providing additional warmth for cooler ambient temperatures or weather.

c) Allows the swaddle garment to be worn with socks, booties, or shoes.

d) Drop-seat opening allows caretaker an alternative access to the infant's lower body, for: checking infant's temperature, checking or changing nappy/diaper, toileting, or toilet training.

e) If adopted to be used by older children and adults (particularly but not limited to those with special needs):

i. They are able to extend their feet out of the feet openings 406*a*, 406*b* with the fold-over feet mittens 410*a*, 410*b* folded back in an open position, and walk around if required, thereby for example: allowing them to get up in the middle of the night to use the toilet, without having to remove the swaddling garment.

ii. The two-way zipper releasable fastening mechanism 174 allows males to urinate, without having to remove the swaddling garment.

iii. The drop-seat fastening mechanism 414 allows the drop-seat opening 412 to be selectively opened and closed, allowing males to defecate and females to both urinate and defecate, without having to remove the swaddling garment.

While the aforementioned description and diagrams contains many specificities, these should not be construed as limitations on the scope, but rather as an exemplification of some of several embodiments and configurations thereof.

It can be understood that any of the elements, features, and structures of the several aforementioned embodiments and configurations or variations thereof, can be combined to allow an infant (or a subset of infants sharing the same preference) to be positioned and supported in their preferred 'optimal fetal position', while the infant's forearms and hands are still positioned and supported in the 'fetal-hand position', and while still sufficiently keeping the upper-arms and elbows tucked-in to the sides of the torso to suppress the startle reflex.

Similarly, it can be understood that any of the elements, features, and structures of the several aforementioned embodiments and configurations or variations thereof, can be combined to provide the infant with progressive freedom of movement of the upper limbs and access to hands and fingers, to smoothly transition/wean off the swaddle.

Further, the several embodiments and configurations are not limited to the precise configuration and components disclosed herein. Disclosed elements, features, or structures may be combined or utilised in connection with other embodiments and configurations, as will be recognised by those skilled in the art. Many other ramifications, variations, and combinations are possible. For example:

Variations in the degree of 'restriction or freedom' of vertical, lateral, and medial movements of the forearms and hands, and variations in 'positioning and support' of the forearms and hands 'laterally away from' or 'medially towards the' midline M, while sufficiently restraining the movements of the upper-arms and elbows, can be achieved by any of the following means:

a) By varying the Length L1 of the inner sides 128*a*, 128*b* while keeping the length L2 of the outer sides 130*a*, 130*b* unchanged, as shown in the embodiments and configurations of FIGS. 1 to 38.

b) By including fold-over hand mittens 136*a*, 136*b* which can be selectively folded between an open or closed position, and in conjunction with hand openings 134*a*, 134*b* preferably being made of elasticised material and sized to fit snugly at the infant's wrist, as shown in the embodiment of FIGS. 20 to 24.

c) By including fold-over hand mittens 136*a*, 136*b* which can be selectively folded between an open or closed position, and in conjunction with thumb holes 138*a*, 138*b* through which the infant's thumbs can extend out to anchor the forearm-hand positioners 126*a*, 126*b*, as shown in the embodiment of FIGS. 25 to 28.

d) By varying the perimeter/circumference length of the hand openings 134*a*, 134*b*, as shown in the embodiment of FIGS. 25 to 28.

e) By varying the perimeter/circumference length and/or shape of the forearm-hand openings 124*a*, 124*b*. For example, by configuring the forearm-hand openings 124*a*, 124*b* to have a much larger perimeter such that they almost entirely cover the chest of the infant on their respective sides; the forearm-hand openings 124*a*, 124*b* would begin at the elbow regions 120*a*, 120*b*, extend past the chest regions 122*a*, 122*b*, ending very close below the front neckline 114 and close to the midline M; thus even if the length L1 of the inner sides 128*a*, 128*b* and length L2 of the outer sides 130*a*, 130*b* were then configured to be of same length, unlike the configuration of FIGS. 25 to 28, the infant's forearms and hand would still be positioned somewhat up-and-towards the midline of the body near the face or mouth (as depicted in FIGS. 37 and 38, which is a positioning more similarly to the embodiment of FIGS. 1 to 19.

f) By configuring the forearm-hand openings 124*a*, 124*b* to being at the elbow regions 120*a*, 120*b* but end at varying regions at or above the chest regions on the front panel 106, as shown in the embodiment of FIGS. 39 to 43.

g) By including more than one pairs of forearm-hand openings 124*a*, 124*b* and forearm-hand positioners 126*a*, 126*b* configured at varying positions on the front panel 106, as shown in the embodiment of FIGS. 39 to 43.

h) By constructing the swaddling garment from different fabrics with varying degree of stretch.

Variations in the degree of 'restrainment or freedom' of movements of the upper-arms and elbows, and therefore variation in the degree of startle reflex suppression, can be achieved by any of the following means:

a) By varying the length L2 of the outer sides 130*a*, 130*b*. For example, when length L2 is approximately the length of the infant's forearms, it provides the most restriction to the movements of the upper-arms and elbows; whereas length L2 that is longer than the length of the infant's forearms allows more of the infant's arms to be enclosed by the forearm-hand positioners 126*a*, 126*b* allowing more freedom of movements of the upper-arms and elbows.

b) By varying the length L2 of the outer sides 130*a*, 130*b* in conjunction with varying the Length L1 of the inner sides 128*a*, 128*b*.

c) By including fold-over hand mittens 136*a*, 136*b* which can be selectively folded between an open or closed position, and in conjunction with hand openings 134*a*, 134*b* preferably being made of elasticised material and sized to fit snugly at the infant's wrist, as shown in the embodiment of FIGS. 20 to 25.

d) By including fold-over hand mittens 136*a*, 136*b* which can be selectively folded between an open or closed position, and in conjunction with thumb holes 138*a*, 138*b* through which the infant's thumbs can extend out to anchor the forearm-hand positioners 126*a*, 126*b*, as shown in the embodiment of FIGS. 25 to 28.

e) By varying the perimeter/circumference length of the hand openings 134*a*, 134*b*, as shown in the embodiment of FIGS. 25 to 28.

f) By constructing the swaddling garment from different fabrics with varying degree of stretch.

Unrestricted skin-to-skin access of the infant's hands and fingers, while sufficiently restraining the movements of the upper-arms and elbows, can be achieved by any of the following means:

a) By including fold-over hand mittens 136*a*, 136*b* which can be selectively folded between an open or closed position, and in conjunction with hand openings 134*a*, 134*b* preferably being made of elasticised material and sized to fit snugly at the infant's wrist, as shown in the embodiment of FIGS. 2A-E.

b) By including fold-over hand mittens 136*a*, 136*b* which can be selectively folded between an open or closed position, and in conjunction with thumb holes 138*a*, 138*b* through which the infant's thumbs can extend out to anchor the forearm-hand positioners 126*a*, 126*b*, as shown in the embodiment of FIGS. 25 to 28.

c) By including fold-over hand mittens 136*a*, 136*b* which can be selectively folded between an open or closed position, and in conjunction with varying the perimeter/circumference length of the hand openings 134*a*, 134*b*, as shown in the embodiment of FIGS. 25 to 28.

The shell portion 104 and the lower section 200 can have other forms, either separately or in combination, such as shell portion and sack portion forming a bodysuit with a releasable fastening mechanism on the front panel 106; shell portion and sack portion forming a kimono styled bodysuit; sack portion with an elasticised main opening at the waist region; shell portion forming a kimono style while sack portion having a side zipper; shell portion and sack portion forming a continuous kimono style; shell portion and sack portion having a continuous side zipper; shell portion and sack portion forming a kimono styled one-piece suit, etc.

The releasable fastening mechanism 174 may be any suitable fastening mechanism, such as but not limited to various types of: zippers, hook and loop fastener, snaps, buttons, draw strings, tie strings, clasps, wraps, straps, magnets, like fasteners, or a combination thereof.

Disclosed elements, features, or structures, can be constructed from any suitable material or combination of materials, such as but not limited to various types of: woven and knitted fabrics, polyester based fabrics, cotton and polyester blend fabrics, quilted fabrics, woollen fabrics, bamboo fabrics, etc; preferably material having elongation and compression ability (able to stretch and return to its original shape) such as, but not limited to fabrics having a mixed composition of cotton and spandex; one or multiple layers of any suitable material of varying warmth or thickness, to allow swaddling for all seasons and ambient temperatures.

Individual disclosed elements, features, or structures can also be constructed to have varying warmth or stretch properties, for example, front panel 106 may be constructed from a quilted fabric to provide warmth, while the forearm-hand positioners 126*a*, 126*b* may be made from thinner stretchy fabric to allow movement of the forearms and hands.

The several embodiments and configurations described in this specification are intended to be used with premature, newborn, and any young infant requiring swaddling. However, it is acknowledged that the embodiments can be easily adopted (as will be recognised by those skilled in the art) to be used by older children and adults, particularly but not limited to those with special needs.

I claim:

1. A swaddling garment for an infant, the garment comprising:

an upper body part for receiving an upper body of the infant, the upper body part having:

a back part that in use covers a back of the infant;

a front part that in use covers a front of the infant;

a midline region that in use covers a midline of the infant;

a right elbow region that in use corresponds to a location of a right elbow of the infant when the infant's right arm is against a right side of a torso of the infant;

a left elbow region that in use corresponds to a location of a left elbow of the infant when the infant's left arm is against a left side of the torso of the infant;

wherein the garment is formed from a flexible material and comprises:

a pair of openings in the front part being a right opening and a left opening, the left opening extending from adjacent the left elbow region inwards into the front part towards the midline region, and the right opening extending from adjacent the right elbow region inwards into the front part towards the midline region, and a pair of forearm positioners being a right forearm positioner and a left forearm positioner, the right forearm positioner being formed, or attached to the front part, so as to be in communication with the right opening, and the left forearm positioner being formed, or attached to the front part, so as to be in communication with the left opening, wherein each opening and a corresponding forearm positioner are configured to allow the infant to extend a forearm through the opening into the forearm positioner to a predetermined forearm position in which the forearm is at least partly over the front of the infant's body, and the infant is able to move the forearm away from the predetermined forearm position against a resistance of the flexible material so as to bias the forearm towards the predetermined forearm position.

2. The swaddling garment of claim 1, wherein each forearm positioner has an outer side having a first length and an inner side having a second length, wherein the first length is greater than the second length such that, when in the predetermined forearm position, the forearm is at an acute angle relative to the front of the infant's body.

3. The swaddling garment of claim 2, wherein the first length is configured to correspond to a total length of the infant's forearm and hand with the hand closed.

4. The swaddling garment of claim 2, wherein the first length is configured to correspond to a total length of the infant's forearm.

5. The swaddling garment of claim 1, wherein the garment is formed from a resilient flexible material.

6. The swaddling garment of claim 5, wherein the garment is configured to allow the infant to move the forearms longitudinally away from the predetermined forearm position against a first degree of resilience and also configured to allow the infant to move the forearms laterally against a second degree of resilience, wherein the first degree of resilience is less than the second degree of resilience.

7. The swaddling garment of claim 1, wherein each forearm positioner has an outer side having a first length and an inner side having a second length, wherein the first length and the second length are the same such that the predetermined forearm position is configured to be orthogonal to the front of the infant's body.

8. The swaddling garment of claim 1, wherein each forearm positioner has an outer side having a first length and an inner side having a second length, wherein the first length is less than the second length such that, when in the predetermined forearm position, the forearm is at an obtuse angle relative to the front of the infant's body.

9. The swaddling garment of claim 1, wherein each opening is configured to extend from the respective elbow region along a line between the elbow region and a mouth of the infant.

10. The swaddling garment of claim 1, wherein each opening is configured to extend from the respective elbow region towards the midline of the infant and end at a lower chest region of the infant.

11. The swaddling garment of claim 1, wherein each opening is configured to extend from the respective elbow region towards the midline of the infant and end at a middle chest region of the infant.

12. The swaddling garment of claim 1, wherein each opening is configured to extend from the respective elbow region towards the midline of the infant and end at a lower abdomen of the infant.

13. The swaddling garment of claim 1, wherein each opening is configured to extend from the respective elbow region toward, and end at, a waist side region of the infant.

14. The swaddling garment of claim 1, wherein each opening is configured to extend from the respective elbow region towards the midline of the infant and end at an armpit region of the infant.

15. The swaddling garment of claim 1, further comprising a second pair of elbow openings and a second pair of sleeves, where the garment is configured such that the or each forearm may be selectively extended into the forearm sleeve, and/or further comprising a lower part for loosely receiving an infant's legs.

16. The swaddling garment of claim 1, wherein the swaddling garment is configured such that, on one or both forearm positioners, an end of the forearm positioner is closed so as to cover a hand of the infant.

17. The swaddling garment of claim 1, wherein the swaddling garment is configured such that, on one or both forearm positioners, an end of the forearm positioner is open so as to allow a hand of the infant to extend therethrough.

18. The swaddling garment of claim 1, wherein the swaddling garment is configured such that, on one or both forearm positioners, an end of the forearm positioner is configured to be selectively moved between a closed position that covers a hand of the infant, and an open position that allows the hand of the infant, or part thereof, to extend therethrough.

19. A method for the prevention or treatment of plagiocephaly in an infant comprising:

providing the swaddling garment of claim 1;

placing the infant into the swaddling garment; and placing one forearm of the infant into one of the forearm positioners of the swaddling garment to provide a free forearm and free hand and allow the infant to make contact with the free hand, and placing the other forearm of the infant inside the front part, and periodically swapping the placement of the infant's forearms so as to alternate the free hand available for making contact.

20. A method for the prevention or treatment of torticollis in an infant, comprising:

providing the swaddling garment of claim 1;

placing the infant into the swaddling garment; and placing one forearm of the infant into one of the forearm positioners of the swaddling garment to provide a free forearm and free hand and allow the infant to make contact with the free hand, and placing the other forearm of the infant inside the front part, and periodically swapping the placement of the infant's forearms so as to alternate the free hand available for making contact.

* * * * *